US007995084B2

(12) United States Patent
Nomura et al.

(10) Patent No.: US 7,995,084 B2
(45) Date of Patent: Aug. 9, 2011

(54) LINE HEAD AND AN IMAGE FORMING APPARATUS USING THE LINE HEAD

(75) Inventors: Yujiro Nomura, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 885 days.

(21) Appl. No.: 11/970,450

(22) Filed: Jan. 7, 2008

(65) Prior Publication Data

US 2008/0180759 A1 Jul. 31, 2008

(30) Foreign Application Priority Data

Jan. 25, 2007 (JP) ..... 2007-015397
Sep. 19, 2007 (JP) ..... 2007-241837

(51) Int. Cl.
*B41J 2/45* (2006.01)

(52) U.S. Cl. ..... 347/238

(58) Field of Classification Search ..... 347/230, 347/234, 237, 238, 244, 247, 248, 258
See application file for complete search history.

(56) References Cited

U.S. PATENT DOCUMENTS 4,435,064 A * 3/1984 Tsukada et al. ..... 355/1
5,825,400 A * 10/1998 Florence ..... 347/239
6,545,811 B1 * 4/2003 Fujimoto ..... 359/619
2008/0181667 A1 * 7/2008 Nomura et al. ..... 399/218

FOREIGN PATENT DOCUMENTS

JP 2000-158705 6/2000

* cited by examiner

*Primary Examiner* — Hai C Pham
(74) *Attorney, Agent, or Firm* — DLA Piper LLP (US)

(57) ABSTRACT

A line head, includes: a plurality of luminous elements grouped into a plurality of luminous element groups; and a lens array which includes a plurality of lenses each of which faces the luminous element group, focuses light beams emitted from the luminous element group on an image plane, and accordingly forms a spot group, wherein the plurality of luminous element groups are arrayed in M×N in a first direction and in a second direction which are different from each other, where M and N are integers equal to or greater than two, and spot groups adjacent to each other in a direction corresponding to the first direction are so formed on the image plane as to partly overlap in a direction corresponding to the second direction.

2 Claims, 32 Drawing Sheets

FIG. 11A : WHEN THERE ARE NEITHER DISPLACEMENTS NOR MAGNIFICATION ERRORS
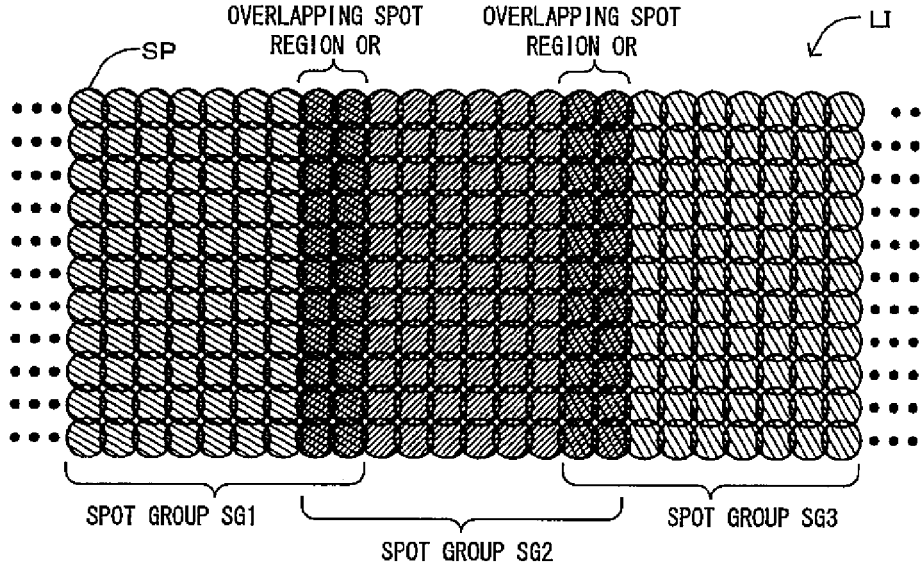
FIG. 11B : WHEN THERE ARE DISPLACEMENTS
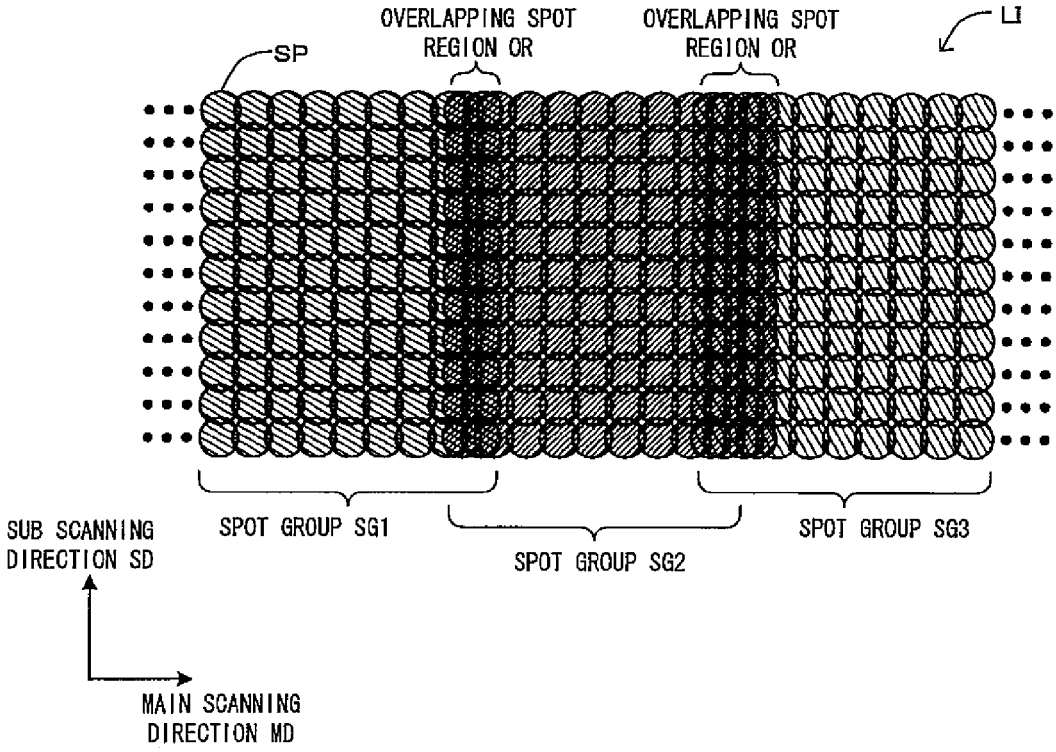

FIG. 12
CORRELATION BETWEEN SPOTS FORMED ON PHOTOSENSITIVE SURFACE IN COMPARATIVE EXAMPLE (WHEN TURNING ON SIMULTANEOUSLY)
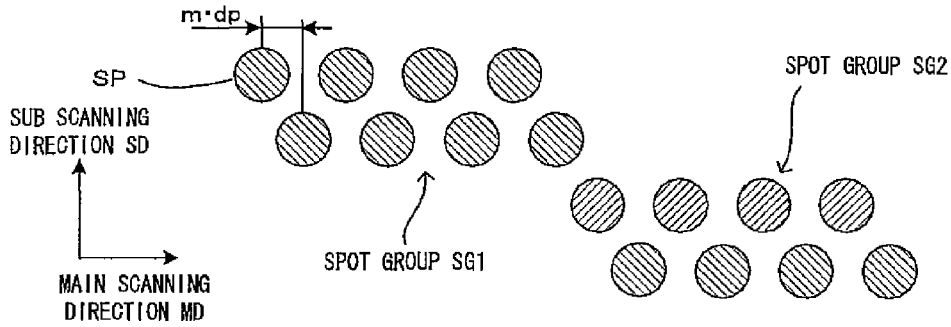
ARRANGEMENT OF LUMINOUS ELEMENTS IN COMPARATIVE EXAMPLE
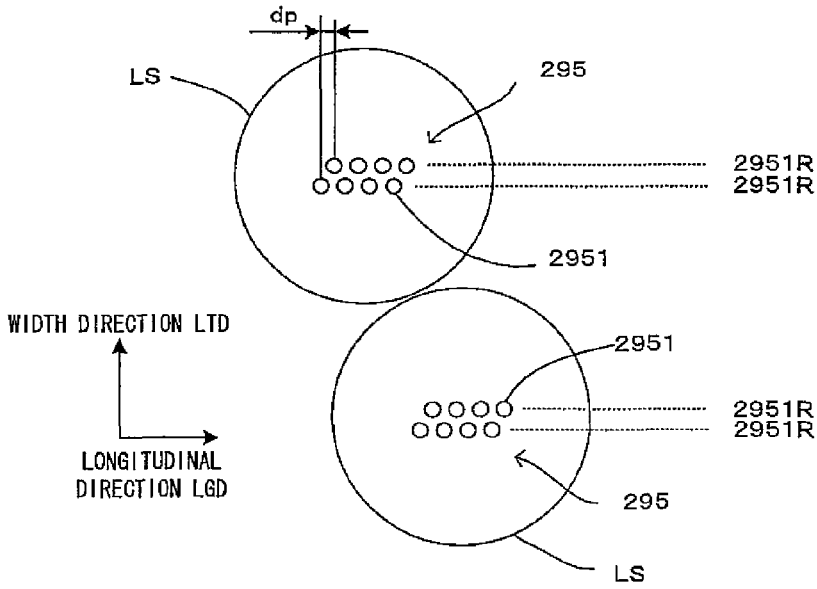

FIG. 13A : WHEN THERE ARE NEITHER DISPLACEMENTS NOR MAGNIFICATION ERRORS IN COMPARATIVE EXAMPLE
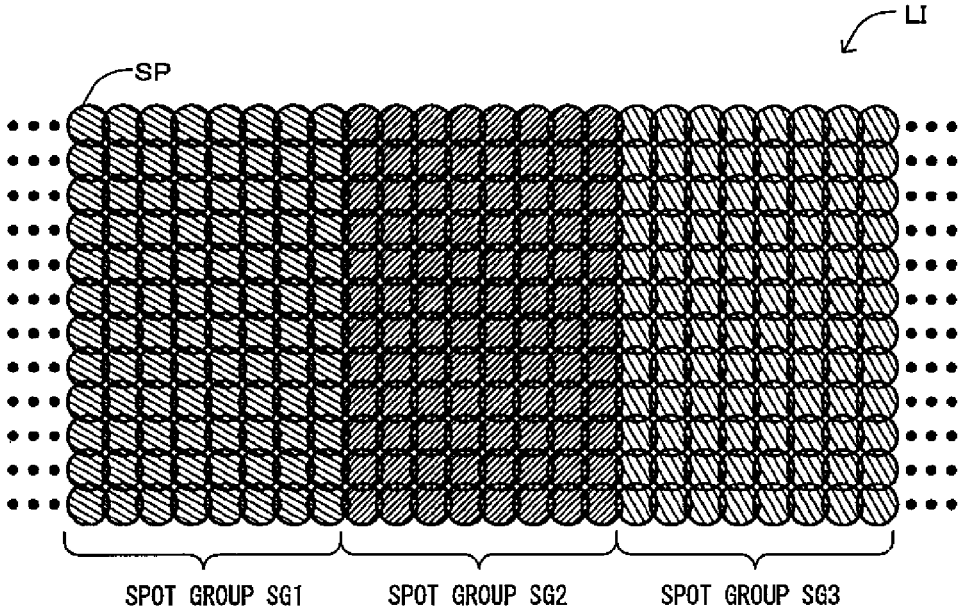
FIG. 13B : WHEN THERE ARE DISPLACEMENTS IN COMPARATIVE EXAMPLE
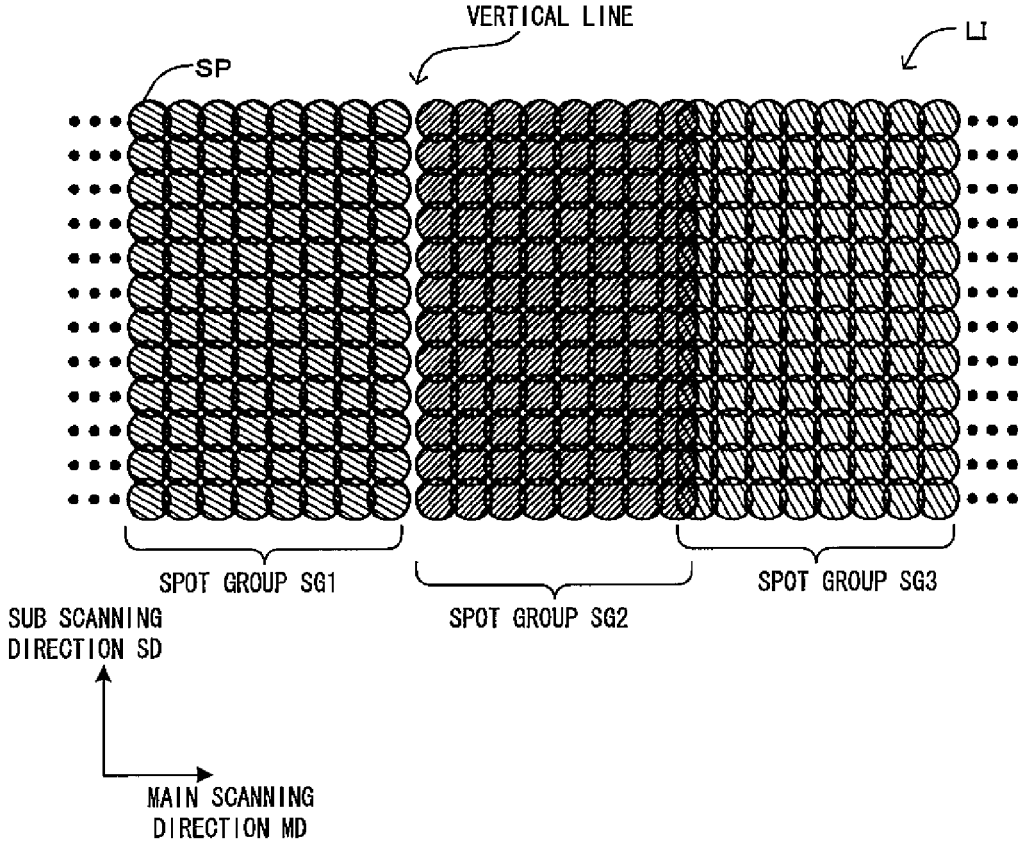

FIG. 14A : WHEN THERE ARE NEITHER DISPLACEMENTS NOR MAGNIFICATION ERRORS IN COMPARATIVE EXAMPLE
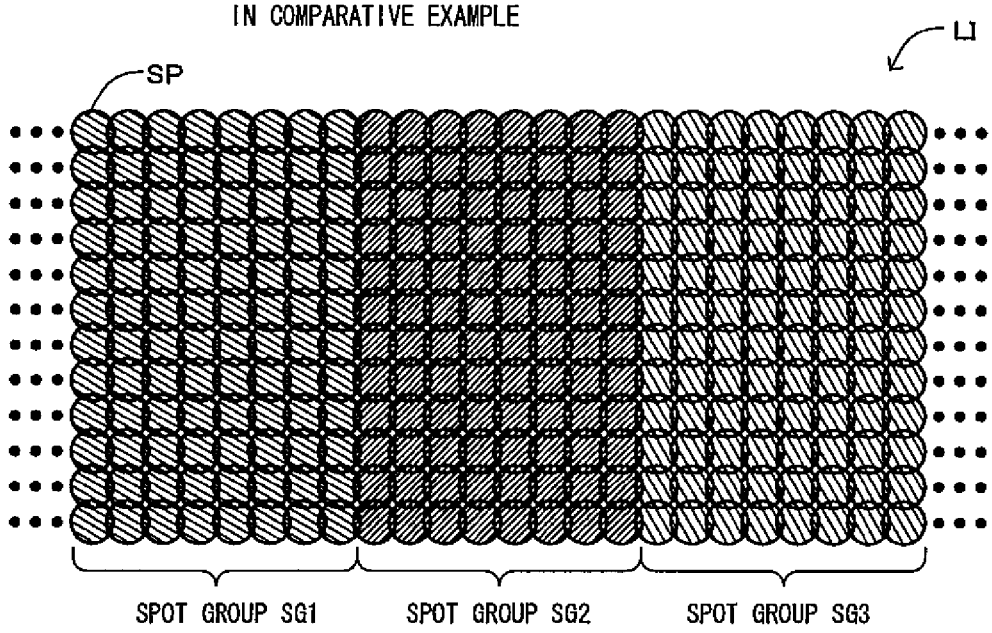
FIG. 14B : WHEN THERE ARE MAGNIFICATION ERRORS IN COMPARATIVE EXAMPLE
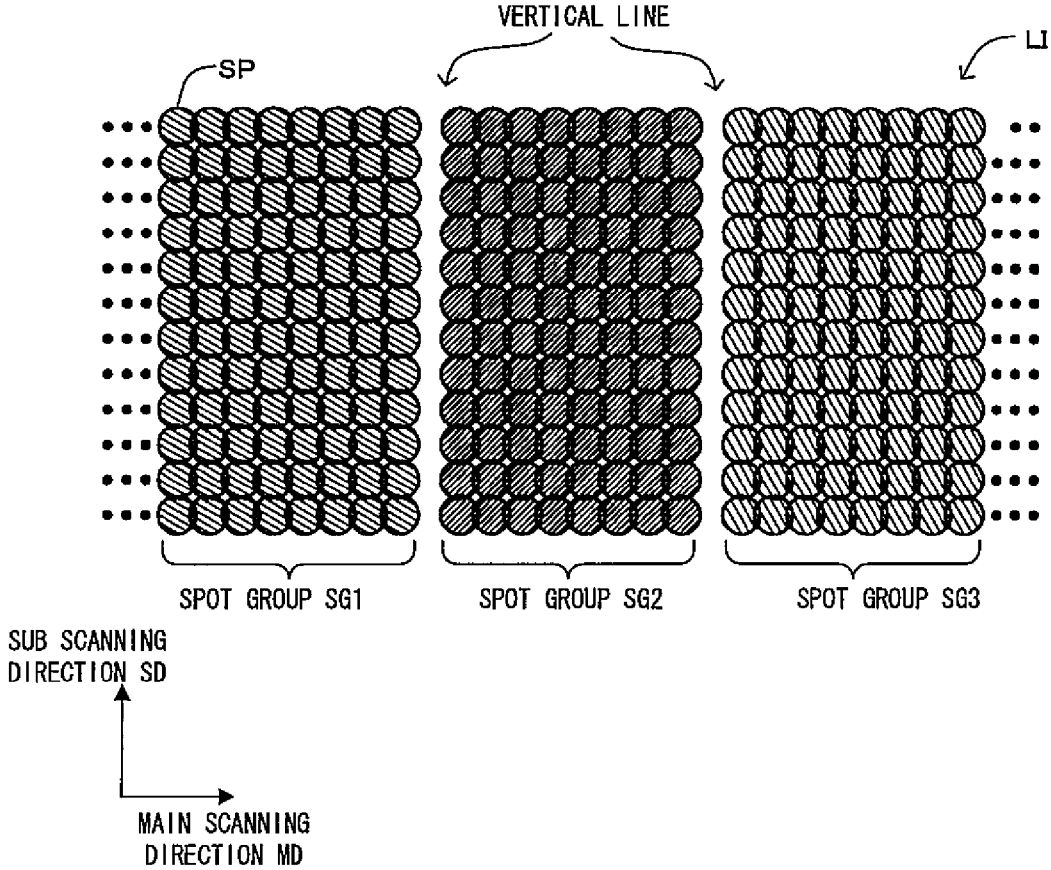

FIG. 29A : WHEN THERE ARE NO DISPLACEMENTS OF LENSES
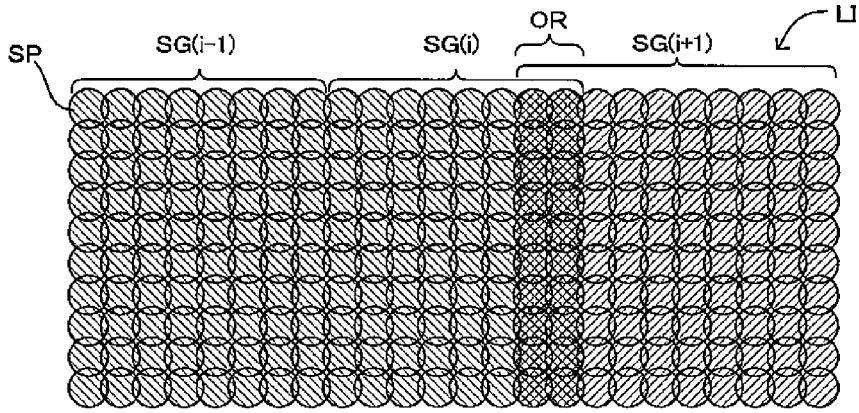
FIG. 29B : WHEN THERE ARE DISPLACEMENTS OF LENSES
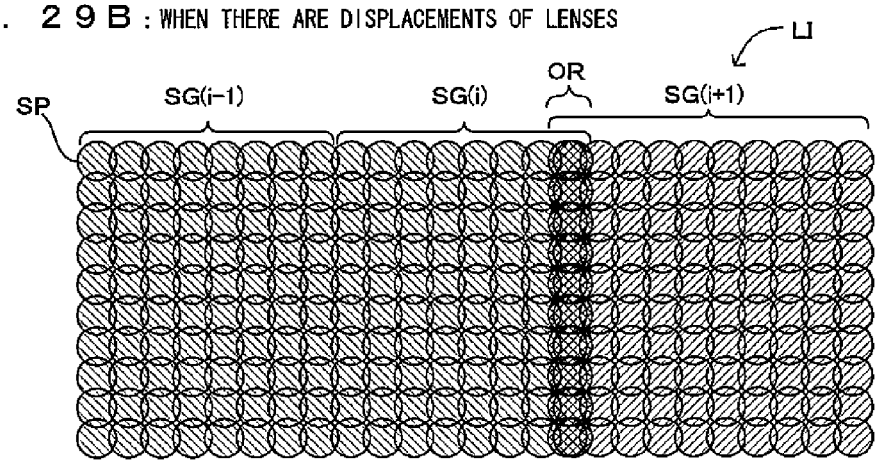
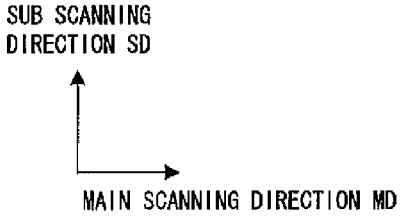

FIG. 33A : WHEN THERE ARE NO DISPLACEMENTS IN COMPARATIVE EXAMPLE
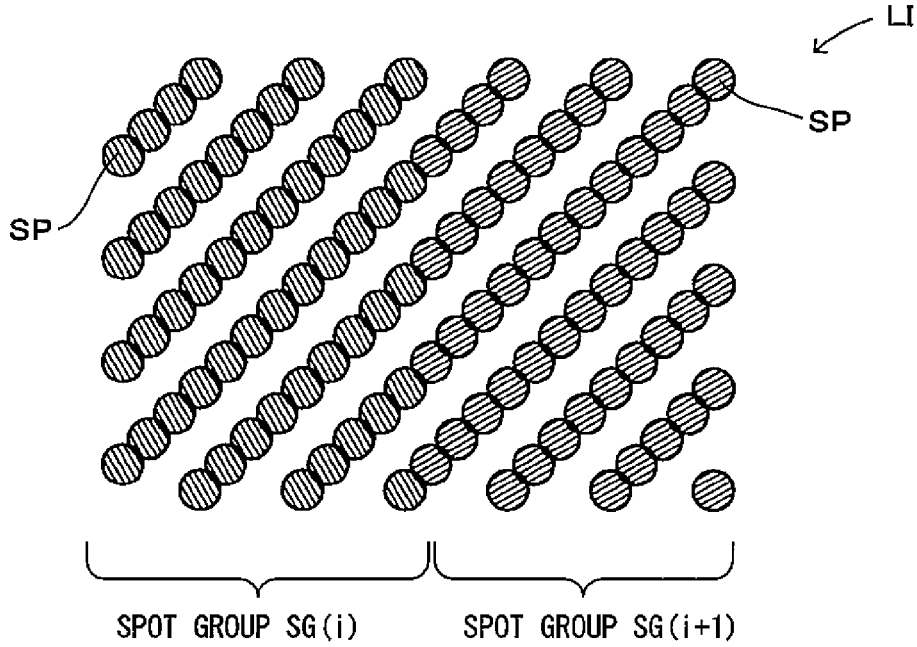
FIG. 33B : WHEN THERE ARE DISPLACEMENTS IN COMPARATIVE EXAMPLE
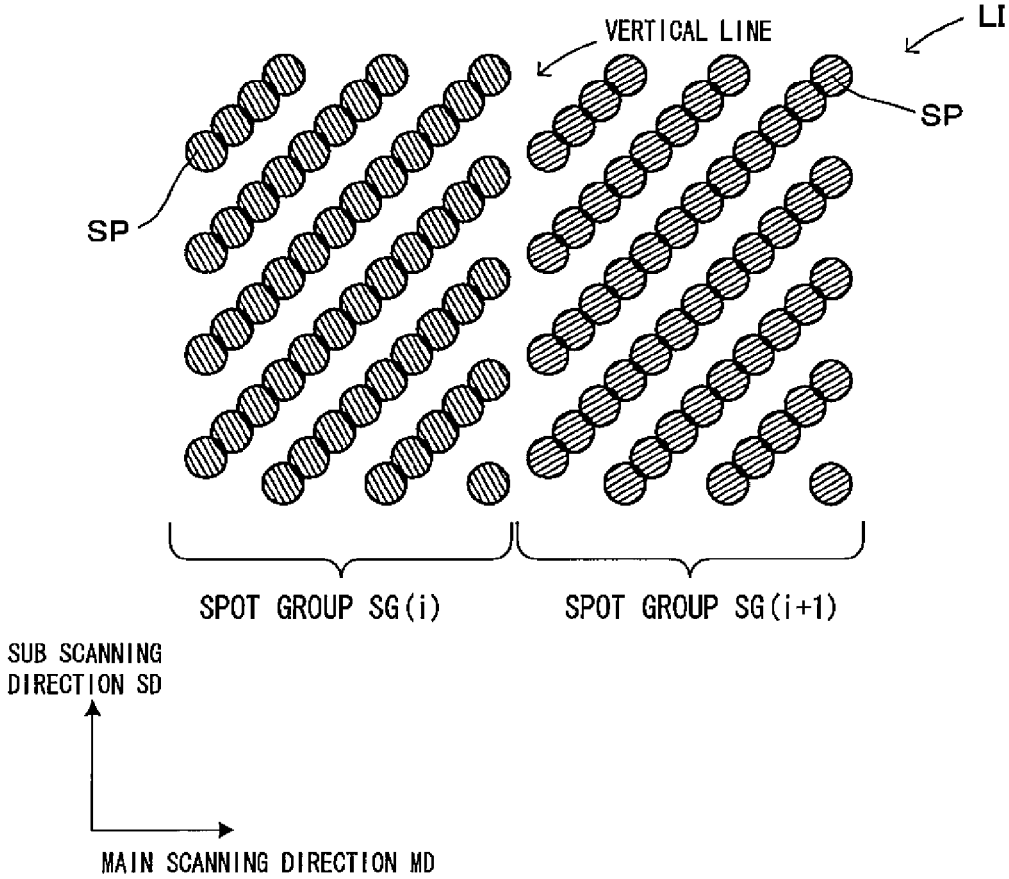

FIG. 34A : WHEN THERE ARE NO DISPLACEMENTS
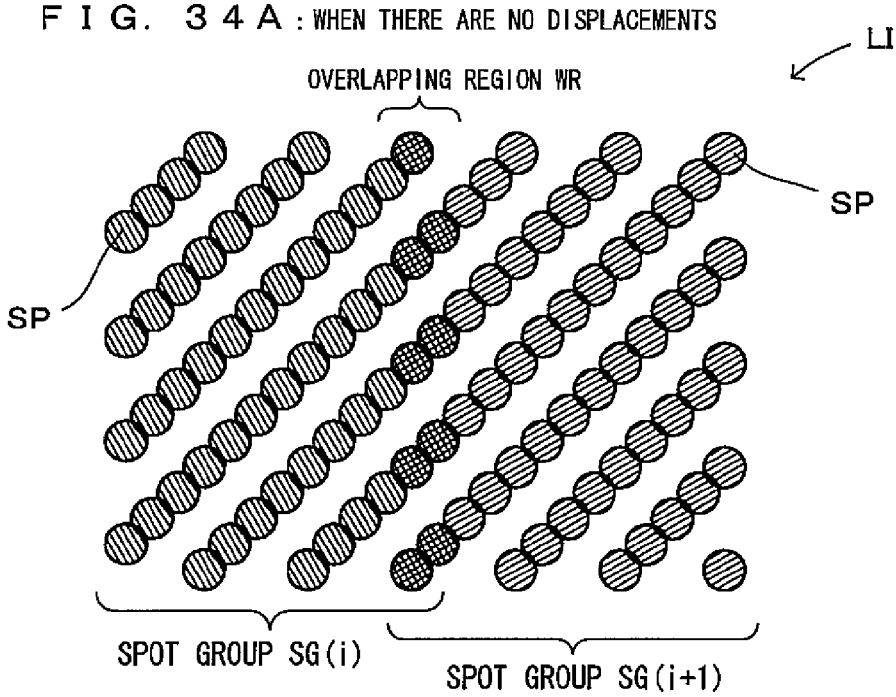
FIG. 34B : WHEN THERE ARE DISPLACEMENTS
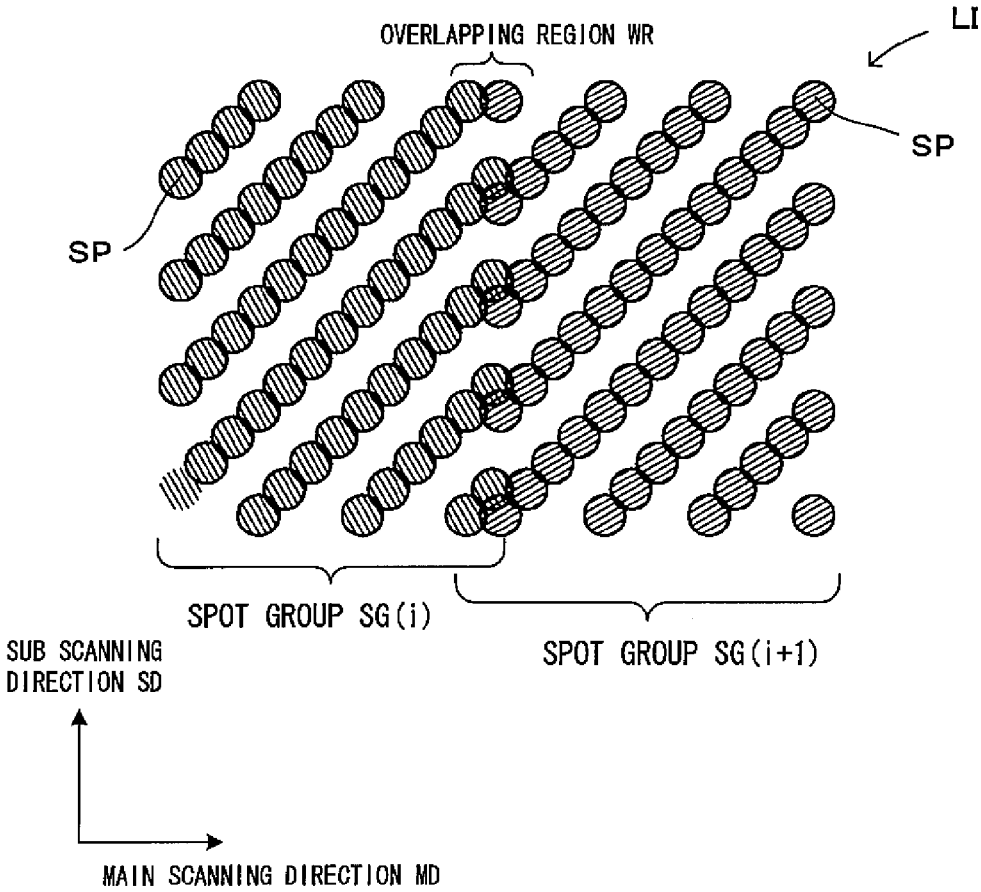

LINE HEAD AND AN IMAGE FORMING APPARATUS USING THE LINE HEAD

CROSS REFERENCE TO RELATED APPLICATION

The disclosure of Japanese Patent Applications No. 2007-015397 filed on Jan. 25, 2007 and No. 2007-241837 filed on Sep. 19, 2007 including specification, drawings and claims is incorporated herein by reference in its entirety.

BACKGROUND

1. Technical Field

The invention relates to a line head including a plurality of luminous elements and adapted to focus light beams emitted from the respective luminous elements on an image plane and an image forming apparatus using the line head.

2. Related Art

A line head using a luminous element array, for example, as disclosed in JP-A-2000-158705 has been proposed as a line head of this type. In this luminous element array, a plurality of luminous elements are linearly arrayed at constant pitches in the longitudinal direction corresponding to a main scanning direction. Further, a plurality of thus constructed luminous element arrays are provided and lenses are arranged in one-to-one correspondence with the respective luminous element arrays. In each luminous element array, light beams are emitted from the plurality of luminous elements belonging to this array, and the emitted light beams are focused on an image plane by the lens arranged in conformity with this array. In this way, spots are formed in a line in the main scanning direction on the image plane.

SUMMARY

A group of spots are formed on the image plane by the luminous elements constituting the luminous element array, thereby forming a spot group. In this spot group, the relative positional relationship of the spots is constant. However, since the plurality of luminous element arrays are arrayed in a direction corresponding to the main scanning direction in the line head of JP-A-2000-158705, there have been cases where the positions of the luminous elements are displaced on an array basis. Upon the occurrence of such displacements, spot positions are relatively displaced among the spot groups, whereby clearances are formed between the spot groups. Particularly in an image forming apparatus for forming a latent image on a photosensitive member using a line head having such a problem and forming a toner image by developing the latent image, image quality is reduced due to vertical lines appearing in the toner image. Since the respective lenses are not integrally constructed in the line head of JP-A-2000-158705, relative position errors of the respective lenses are large. Thus, there have been cases where the spot positions on the image plane are displaced among the respective spot groups and a problem similar to the above occurs.

An advantage of some aspects of the invention is to provide a technique capable of realizing satisfactory spot formation in a line head and an image forming apparatus using a plurality of luminous elements.

According to a first aspect of the invention, there is provided a line head, comprising: a plurality of luminous elements grouped into a plurality of luminous element groups; and a lens array which includes a plurality of lenses each of which faces the luminous element group, focuses light beams emitted from the luminous element group on an image plane, and accordingly forms a spot group, wherein the plurality of luminous element groups are arrayed in M×N in a first direction and in a second direction which are different from each other, where M and N are integers equal to or greater than two, and spot groups adjacent to each other in a direction corresponding to the first direction are so formed on the image plane as to partly overlap in a direction corresponding to the second direction.

According to a second aspect of the invention, there is provided an image forming apparatus, comprising: a latent image carrier whose surface is conveyed in a specified conveying direction; and a line head which forms a latent image on the surface of the latent image carrier, wherein the line head includes: a plurality of luminous elements grouped into a plurality of luminous element groups; and a lens array which includes a plurality of lenses each of which faces the luminous element group, focuses light beams emitted from the luminous element group on the latent image carrier, and accordingly forms a spot group, wherein the plurality of luminous element groups are arrayed in M×N in a first direction and in a second direction which are different from each other, where M and N are integers equal to or greater than two, and wherein spot groups adjacent to each other in a direction corresponding to the first direction are so formed on the latent image carrier as to partly overlap in a direction corresponding to the second direction.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIGS. 11A and 11B are diagrams showing a two-dimensional latent image formed on the photosensitive surface by the line head.

FIG. 12 is a diagram showing a comparative example of the line head.

FIGS. 13A, 13B, 14A and 14B are diagrams showing a state of spots formed by the comparative example of FIG. 12.

FIGS. 29A and 29B are diagrams showing a two-dimensional latent image formed on the photosensitive surface by the line head.

FIGS. 33A and 33B are diagrams showing a screen pattern formed by a comparative example.

FIGS. 34A and 34B are diagrams showing a screen pattern formed by an eighth embodiment according to the invention.

DESCRIPTION OF EXEMPLARY EMBODIMENTS

A. Description of Terminology

Before describing embodiments of the invention, terminology used in this specification is described.

Figure 1:
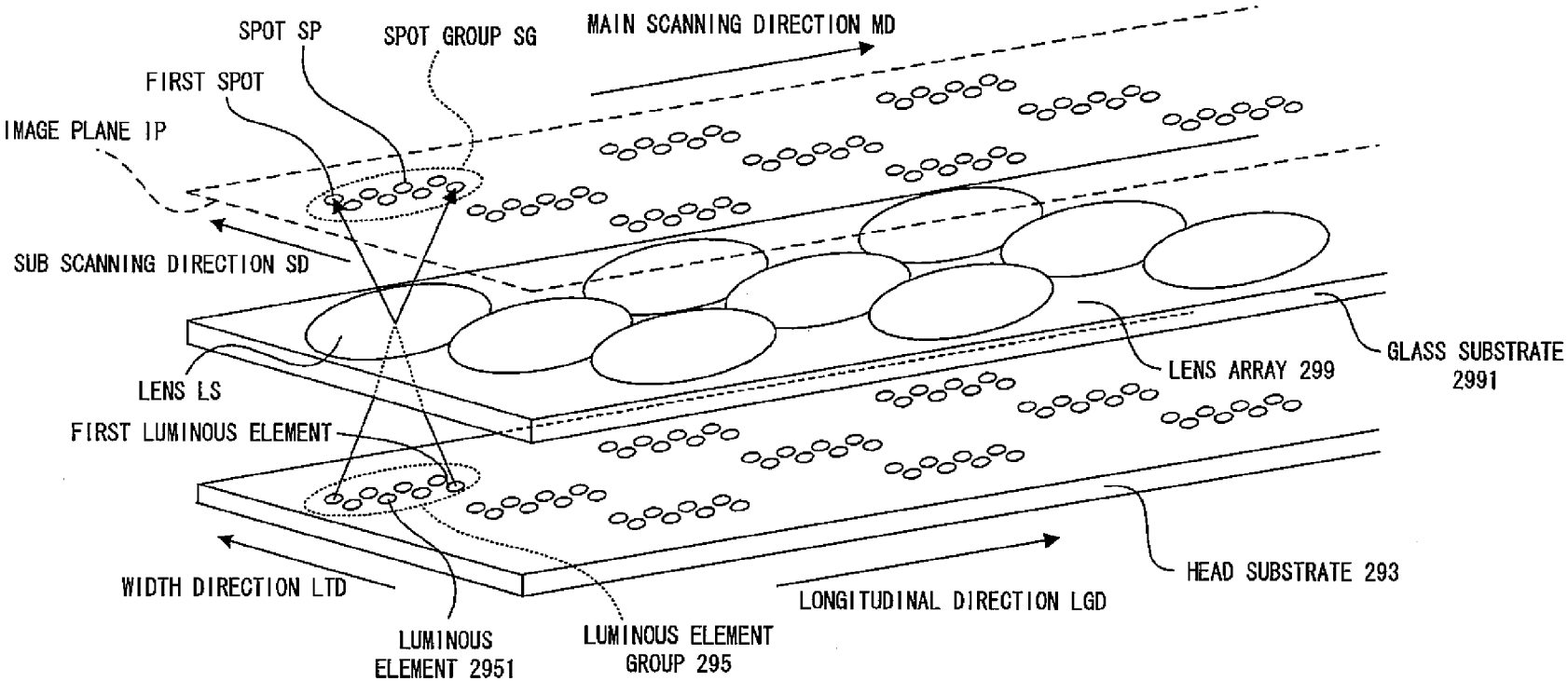
FIGS. 1 and 2 are diagrams showing terminology used in this specification.
Figure 2:
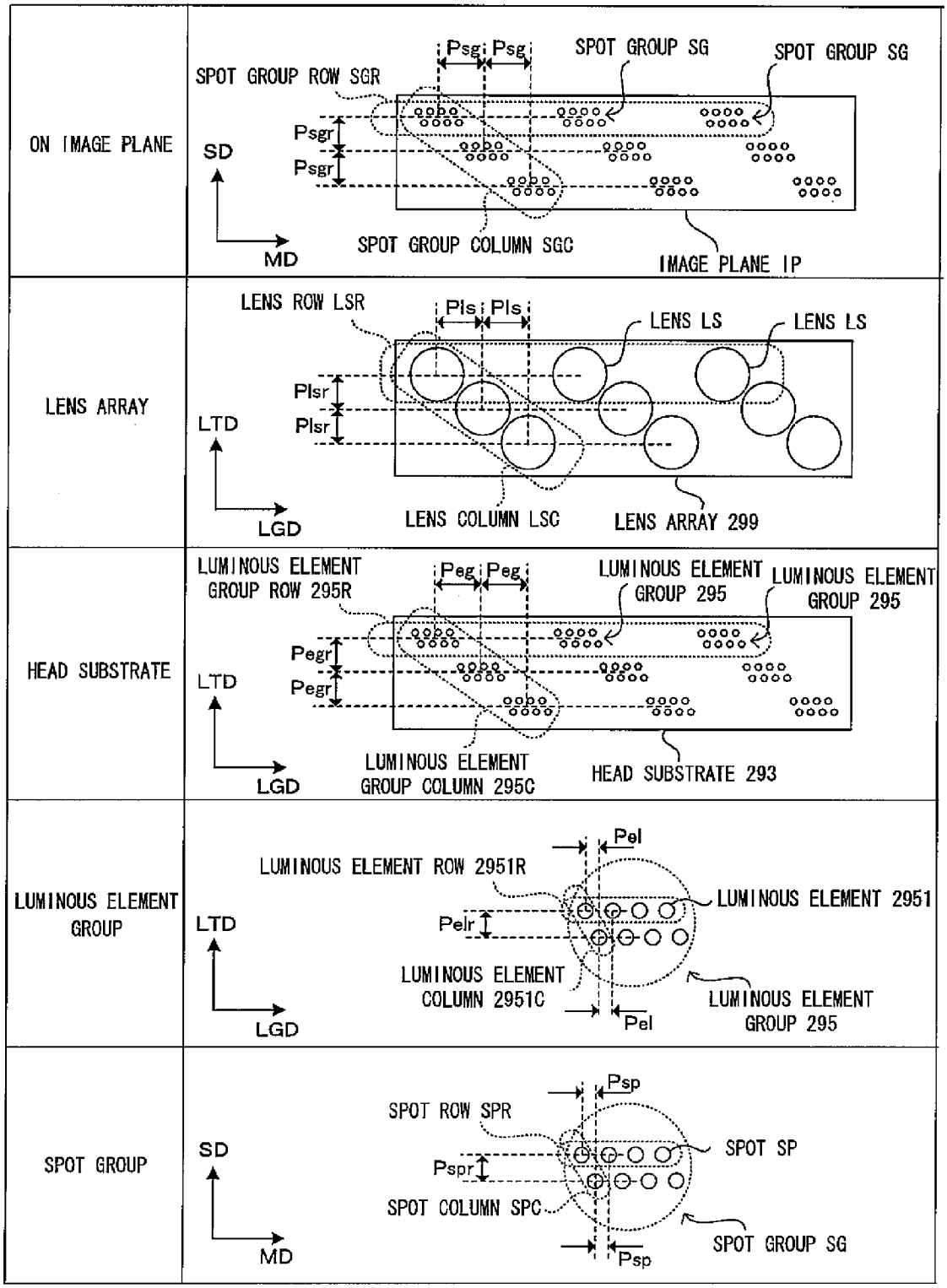

FIGS. 1 and 2 are diagrams showing terminology used in this specification. Here, terminology used in this specification is organized with reference to FIGS. 1 and 2. In this specification, a conveying direction of a surface (image plane IP) of a photosensitive drum 21 is defined to be a sub scanning direction SD and a direction normal to or substantially normal to the sub scanning direction SD is defined to be a main scanning direction MD. Further, a line head 29 is arranged relative to the surface (image plane IP) of the photosensitive drum 21 such that its longitudinal direction LGD corresponds to the main scanning direction MD and its width direction LTD corresponds to the sub scanning direction SD.

Collections of a plurality of (eight in FIGS. 1 and 2) luminous elements 2951 arranged on a head substrate 293 in one-to-one correspondence with a plurality of lenses LS of a lens array 299 are defined to be luminous element groups 295. In other words, in the head substrate 293, the luminous element groups 295 each including the plurality of luminous elements 2951 are arranged in conformity with the respective lenses LS. Further, collections of a plurality of spots SP formed on the image plane IP by focusing light beams from the luminous element groups 295 toward the image plane IP by the lenses LS corresponding to the luminous element groups 295 are defined to be spot groups SG. In other words, a plurality of spot groups SG can be formed in one-to-one correspondence with the plurality of luminous element groups 295. In each spot group SG, the most upstream spot in the main scanning direction MD and the sub scanning direction SD is particularly defined to be a first spot. The luminous element 2951 corresponding to the first spot is particularly defined to be a first luminous element.

FIGS. 1 and 2 show a case where the spots SP are formed with the image plane kept stationary in order to facilitate the understanding of the correspondence relationship of the luminous element groups 295, the lenses LS and the spot groups SG. Accordingly, the formation positions of the spots SP in the spot groups SG are substantially similar to the arranged positions of the luminous elements 2951 in the luminous element groups 295. However, as described later, an actual spot forming operation is performed while the image plane IP (surface of the photosensitive drum 21) is conveyed in the sub scanning direction SD. As a result, the spots SP formed by the plurality of luminous elements 2951 of the head substrate 293 are formed on a straight line substantially parallel to the main scanning direction MD.

Further, spot group rows SGR and spot group columns SGC are defined as shown in the column "On Image Plane" of FIG. 2. Specifically, a plurality of spot groups SG aligned in the main scanning direction MD is defined to be the spot group row SGR. A plurality of spot group rows SGR are arranged at specified spot group row pitches Psgr in the sub scanning direction SD. Further, a plurality of (three in FIG. 2) spot groups SG arranged at the spot group row pitches Psgr in the sub scanning direction SD and at spot group pitches Psg in the main scanning direction MD are defined to be the spot group column SGC. It should be noted that the spot group row pitch Psgr is a distance in the sub scanning direction SD between the geometric centers of gravity of the two spot group rows SGR adjacent in the sub scanning direction SD and that the spot group pitch Psg is a distance in the main scanning direction MD between the geometric centers of gravity of the two spot groups SG adjacent in the main scanning direction MD.

Lens rows LSR and lens columns LSC are defined as shown in the column of "Lens Array" of FIG. 2. Specifically, a plurality of lenses LS aligned in the longitudinal direction LGD is defined to be the lens row LSR. A plurality of lens rows LSR are arranged at specified lens row pitches Plsr in the width direction LTD. Further, a plurality of (three in FIG. 2) lenses LS arranged at the lens row pitches Plsr in the width direction LTD and at lens pitches Pls in the longitudinal direction LGD are defined to be the lens column LSC. It should be noted that the lens row pitch Plsr is a distance in the width direction LTD between the geometric centers of gravity of the two lens rows LSR adjacent in the width direction LTD and that the lens pitch Pls is a distance in the longitudinal direction LGD between the geometric centers of gravity of the two lenses LS adjacent in the longitudinal direction LGD.

Luminous element group rows 295R and luminous element group columns 295C are defined as in the column "Head Substrate" of FIG. 2. Specifically, a plurality of luminous element groups 295 aligned in the longitudinal direction LGD is defined to be the luminous element group row 295R. A plurality of luminous element group rows 295R are arranged at specified luminous element group row pitches Pegr in the width direction LTD. Further, a plurality of (three in FIG. 2)

luminous element groups 295 arranged at the luminous element group row pitches Pegr in the width direction LTD and at luminous element group pitches Peg in the longitudinal direction LGD are defined to be the luminous element group column 295C. It should be noted that the luminous element group row pitch Pegr is a distance in the width direction LTD between the geometric centers of gravity of the two luminous element group rows 295R adjacent in the width direction LTD and that the luminous element group pitch Peg is a distance in the longitudinal direction LGD between the geometric centers of gravity of the two luminous element groups 295 adjacent in the longitudinal direction LGD.

Luminous element rows 2951R and luminous element columns 2951C are defined as in the column "Luminous Element Group" of FIG. 2. Specifically, in each luminous element group 295, a plurality of luminous elements 2951 aligned in the longitudinal direction LGD is defined to be the luminous element row 2951R. A plurality of luminous element rows 2951R are arranged at specified luminous element row pitches Pelr in the width direction LTD. Further, a plurality of (two in FIG. 2) luminous elements 2951 arranged at the luminous element row pitches Pelr in the width direction LTD and at luminous element pitches Pel in the longitudinal direction LGD are defined to be the luminous element column 2951C. It should be noted that the luminous element row pitch Pelr is a distance in the width direction LTD between the geometric centers of gravity of the two luminous element rows 2951R adjacent in the width direction LTD and that the luminous element pitch Pel is a distance in the longitudinal direction LGD between the geometric centers of gravity of the two luminous elements 2951 adjacent in the longitudinal direction LGD.

Spot rows SPR and spot columns SPC are defined as shown in the column "Spot Group" of FIG. 2. Specifically, in each spot group SG, a plurality of spots SG aligned in the longitudinal direction LGD is defined to be the spot row SPR. A plurality of spot rows SPR are arranged at specified spot row pitches Pspr in the width direction LTD. Further, a plurality of (two in FIG. 2) spots arranged at the spot row pitches Pspr in the width direction LTD and at spot pitches Psp in the longitudinal direction LGD are defined to be the spot column SPC. It should be noted that the spot row pitch Pspr is a distance in the sub scanning direction SD between the geometric centers of gravity of the two spot rows SPR adjacent in the sub scanning direction and that the spot pitch Psp is a distance in the main scanning direction MD between the geometric centers of gravity of the two spots SP adjacent in the main scanning direction MD.

B. First Embodiment

Figure 3:
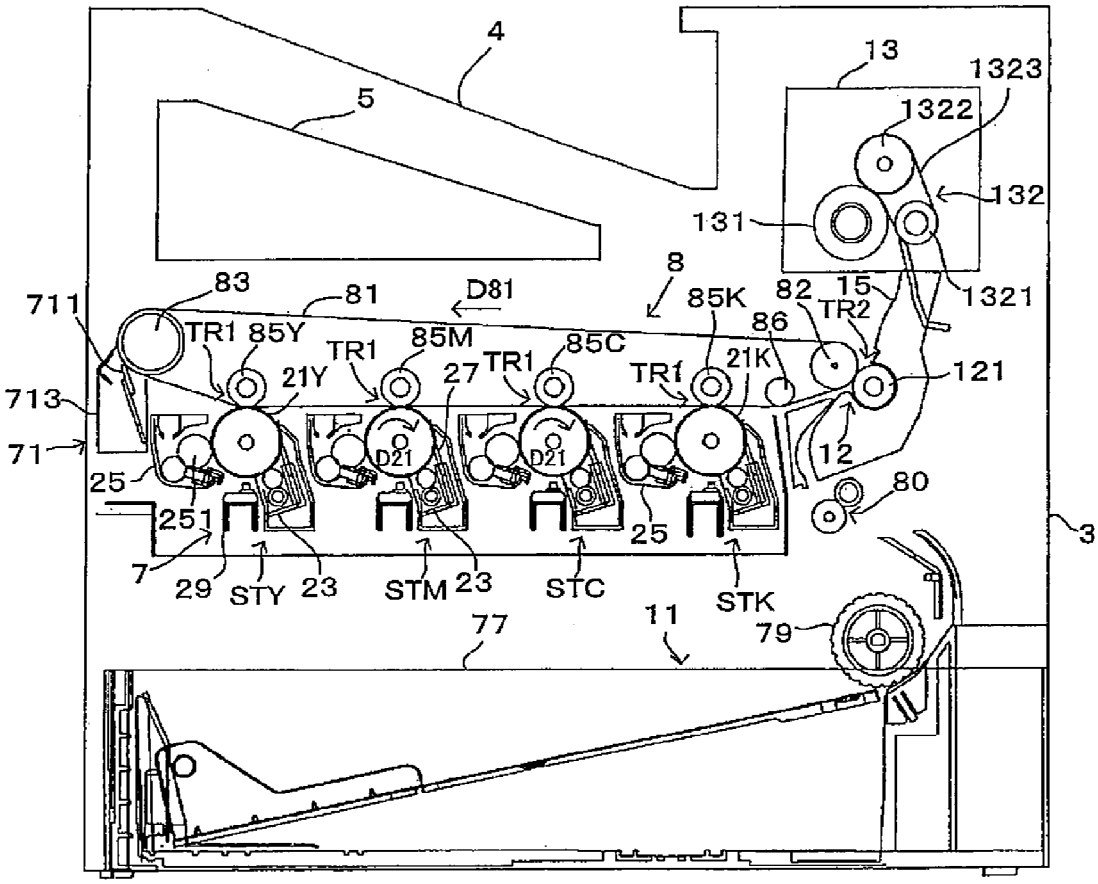
FIG. 3 is a diagram showing a first embodiment of an image forming apparatus according to the invention.
Figure 4:
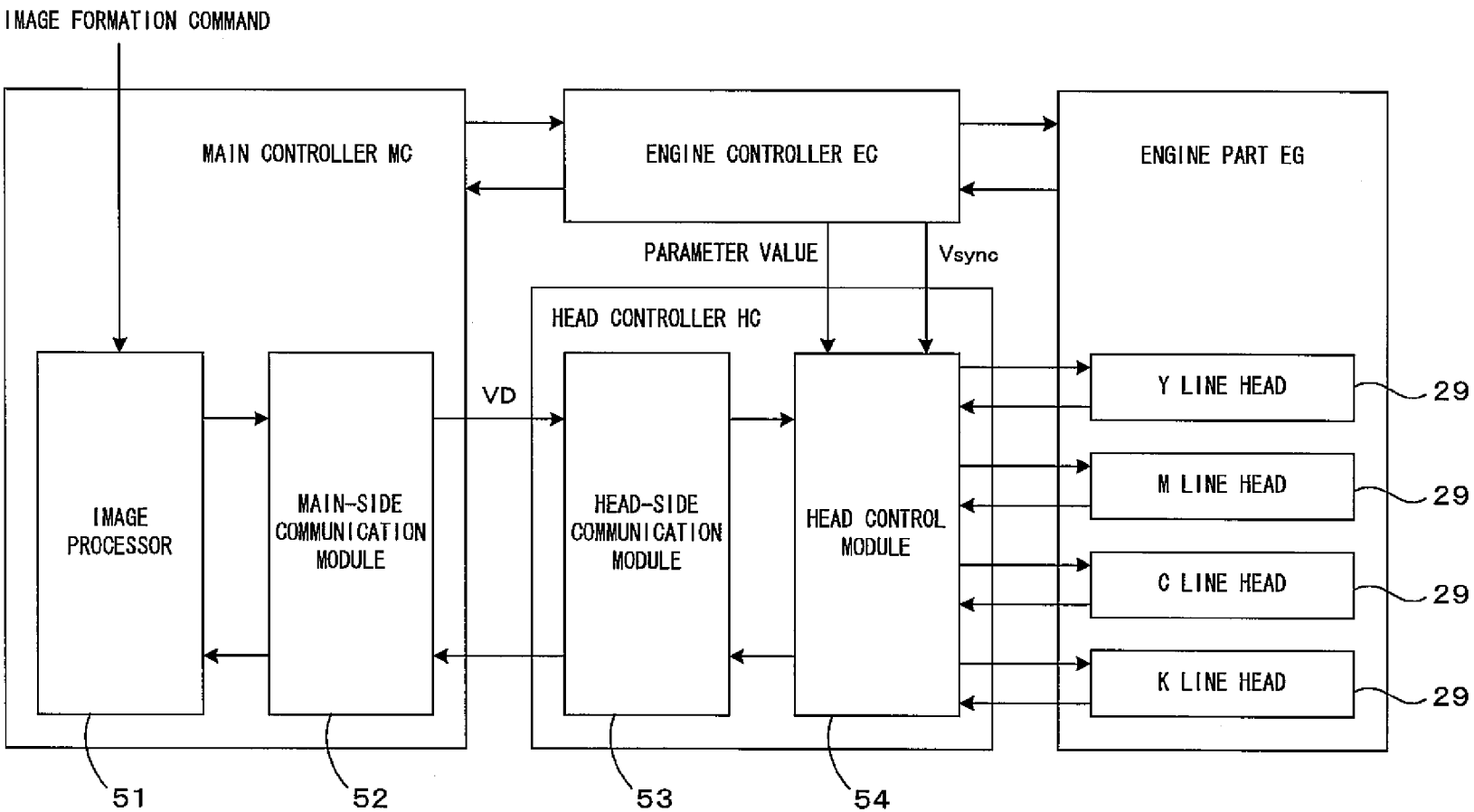
FIG. 4 is a diagram showing the electrical construction of the image forming apparatus of FIG. 3.

FIG. 3 is a diagram showing a first embodiment of an image forming apparatus according to the invention, and FIG. 4 is a diagram showing the electrical construction of the image forming apparatus of FIG. 3. This apparatus is an image forming apparatus that can selectively execute a color mode for forming a color image by superimposing four color toners of black (K), cyan (C), magenta (M) and yellow (Y) and a monochromatic mode for forming a monochromatic image using only black (K) toner. FIG. 3 is a diagram corresponding to the execution of the color mode. In this image forming apparatus, when an image formation command is given from an external apparatus such as a host computer to a main controller MC having a CPU and memories, the main controller MC feeds a control signal and the like to an engine controller EC and feeds video data VD corresponding to the image formation command to a head controller HC. This head controller HC controls line heads 29 of the respective colors based on the video data VD from the main controller MC, a vertical synchronization signal Vsync from the engine controller EC and parameter values from the engine controller EC. In this way, an engine part EG performs a specified image forming operation to form an image corresponding to the image formation command on a sheet such as a copy sheet, transfer sheet, form sheet or transparent sheet for OHP.

An electrical component box 5 having a power supply circuit board, the main controller MC, the engine controller EC and the head controller HC built therein is disposed in a housing main body 3 of the image forming apparatus according to this embodiment. An image forming unit 7, a transfer belt unit 8 and a sheet feeding unit 11 are also arranged in the housing main body 3. A secondary transfer unit 12, a fixing unit 13, and a sheet guiding member 15 are arranged at the right side in the housing main body 3 in FIG. 3. It should be noted that the sheet feeding unit 11 is detachably mountable into the housing main body 3. The sheet feeding unit 11 and the transfer belt unit 8 are so constructed as to be detachable for repair or exchange respectively.

The image forming unit 7 includes four image forming stations STY (for yellow), STM (for magenta), STC (for cyan) and STK (for black) which form a plurality of images having different colors. Each of the image forming stations STY, STM, STC and STK includes a photosensitive drum 21 on the surface of which a toner image of the corresponding color is to be formed. Each photosensitive drum 21 is connected to its own driving motor and is driven to rotate at a specified speed in a direction of arrow D21 in FIG. 3, whereby the surface of the photosensitive drum 21 is transported in a sub scanning direction. Further, a charger 23, the line head 29, a developer 25 and a photosensitive drum cleaner 27 are arranged in a rotating direction around each photosensitive drum 21. A charging operation, a latent image forming operation and a toner developing operation are performed by these functional sections. Accordingly, a color image is formed by superimposing toner images formed by all the image forming stations STY, STM, STC and STK on a transfer belt 81 of the transfer belt unit 8 at the time of executing the color mode, and a monochromatic image is formed using only a toner image formed by the image forming station STK at the time of executing the monochromatic mode. Meanwhile, since the respective image forming stations of the image forming unit 7 are identically constructed, reference characters are given to only some of the image forming stations while being not given to the other image forming stations in order to facilitate the diagrammatic representation in FIG. 3.

The charger 23 includes a charging roller having the surface thereof made of an elastic rubber. This charging roller is constructed to be rotated by being held in contact with the surface of the photosensitive drum 21 at a charging position. As the photosensitive drum 21 rotates, the charging roller is rotated at the same circumferential speed in a direction driven by the photosensitive drum 21. This charging roller is connected to a charging bias generator (not shown) and charges the surface of the photosensitive drum 21 at the charging position where the charger 23 and the photosensitive drum 21 are in contact upon receiving the supply of a charging bias from the charging bias generator.

Each line head 29 includes a plurality of luminous elements arrayed in the axial direction of the photosensitive drum 21 (direction normal to the plane of FIG. 3) and is positioned separated from the photosensitive drum 21. Light beams are emitted from these luminous elements to the surface of the photosensitive drum 21 charged by the charger 23, thereby forming a latent image on this surface. In this embodiment, the head controller HC is provided to control the line heads 29 of the respective colors, and controls the respective line heads 29 based on the video data VD from the main controller MC and a signal from the engine controller EC. Specifically, in this embodiment, image data included in an image formation command is inputted to an image processor 51 of the main controller MC. Then, video data VD of the respective colors are generated by applying various image processings to the image data, and the video data VD are fed to the head controller HC via a main-side communication module 52. In the head controller HC, the video data VD are fed to a head control module 54 via a head-side communication module 53. Signals representing parameter values relating to the formation of a latent image and the vertical synchronization signal Vsync are fed to this head control module 54 from the engine controller EC as described above. Based on these signals, the video data VD and the like, the head controller HC generates signals for controlling the driving of the elements of the line heads 29 of the respective colors and outputs them to the respective line heads 29. In this way, the operations of the luminous elements in the respective line heads 29 are suitably controlled to form latent images corresponding to the image formation command.

In this embodiment, the photosensitive drum 21, the charger 23, the developer 25 and the photosensitive drum cleaner 27 of each of the image forming stations STY, STM, STC and STK are unitized as a photosensitive cartridge. Further, each photosensitive cartridge includes a nonvolatile memory for storing information on the photosensitive cartridge. Wireless communication is performed between the engine controller EC and the respective photosensitive cartridges. By doing so, the information on the respective photosensitive cartridges is transmitted to the engine controller EC and information in the respective memories can be updated and stored.

The developer 25 includes a developing roller 251 carrying toner on the surface thereof. By a development bias applied to the developing roller 251 from a development bias generator (not shown) electrically connected to the developing roller 251, charged toner is transferred from the developing roller 251 to the photosensitive drum 21 to develop the latent image formed by the line head 29 at a development position where the developing roller 251 and the photosensitive drum 21 are in contact.

The toner image developed at the development position in this way is primarily transferred to the transfer belt 81 at a primary transfer position TR1 to be described later where the transfer belt 81 and each photosensitive drum 21 are in contact after being transported in the rotating direction D21 of the photosensitive drum 21.

Further, in this embodiment, the photosensitive drum cleaner 27 is disposed in contact with the surface of the photosensitive drum 21 downstream of the primary transfer position TR1 and upstream of the charger 23 with respect to the rotating direction D21 of the photosensitive drum 21. This photosensitive drum cleaner 27 removes the toner remaining on the surface of the photosensitive drum 21 to clean after the primary transfer by being held in contact with the surface of the photosensitive drum.

The transfer belt unit 8 includes a driving roller 82, a driven roller (blade facing roller) 83 arranged to the left of the driving roller 82 in FIG. 3, and the transfer belt 81 mounted on these rollers and driven to turn in a direction of arrow D81 in FIG. 3 (conveying direction). The transfer belt unit 8 also includes four primary transfer rollers 85Y, 85M, 85C and 85K arranged to face in a one-to-one relationship with the photosensitive drums 21 of the respective image forming stations STY, STM, STC and STK inside the transfer belt 81 when the photosensitive cartridges are mounted. These primary transfer rollers 85Y, 85M, 85C and 85K are respectively electrically connected to a primary transfer bias generator not shown. As described in detail later, at the time of executing the color mode, all the primary transfer rollers 85Y, 85M, 85C and 85K are positioned on the sides of the image forming stations STY, STM, STC and STK as shown in FIG. 3, whereby the transfer belt 81 is pressed into contact with the photosensitive drums 21 of the image forming stations STY, STM, STC and STK to form the primary transfer positions TR1 between the respective photosensitive drums 21 and the transfer belt 81. By applying primary transfer biases from the primary transfer bias generator to the primary transfer rollers 85Y, 85M, 85C and 85K at suitable timings, the toner images formed on the surfaces of the respective photosensitive drums 21 are transferred to the surface of the transfer belt 81 at the corresponding primary transfer positions TR1 to form a color image.

On the other hand, out of the four primary transfer rollers 85Y, 85M, 85C and 85K, the color primary transfer rollers 85Y, 85M, 85C are separated from the facing image forming stations STY, STM and STC and only the monochromatic primary transfer roller 85K is brought into contact with the image forming station STK at the time of executing the monochromatic mode, whereby only the monochromatic image forming station STK is brought into contact with the transfer belt 81. As a result, the primary transfer position TR1 is formed only between the monochromatic primary transfer roller 85K and the image forming station STK. By applying a primary transfer bias at a suitable timing from the primary transfer bias generator to the monochromatic primary transfer roller 85K, the toner image formed on the surface of the photosensitive drum 21 is transferred to the surface of the transfer belt 81 at the primary transfer position TR1 to form a monochromatic image.

The transfer belt unit 8 further includes a downstream guide roller 86 disposed downstream of the monochromatic primary transfer roller 85K and upstream of the driving roller 82. This downstream guide roller 86 is so disposed as to come into contact with the transfer belt 81 on an internal common tangent to the primary transfer roller 85K and the photosensitive drum 21 at the primary transfer position TR1 formed by the contact of the monochromatic primary transfer roller 85K with the photosensitive drum 21 of the image forming station STK.

The driving roller 82 drives to rotate the transfer belt 81 in the direction of the arrow D81 and doubles as a backup roller for a secondary transfer roller 121. A rubber layer having a thickness of about 3 mm and a volume resistivity of 1000 kΩ·cm or lower is formed on the circumferential surface of the driving roller 82 and is grounded via a metal shaft, thereby serving as an electrical conductive path for a secondary transfer bias to be supplied from an unillustrated secondary transfer bias generator via the secondary transfer roller 121. By providing the driving roller 82 with the rubber layer having high friction and shock absorption, an impact caused upon the entrance of a sheet into a contact part (secondary transfer position TR2) of the driving roller 82 and the secondary transfer roller 121 is unlikely to be transmitted to the transfer belt 81 and image deterioration can be prevented.

The sheet feeding unit 11 includes a sheet feeding section which has a sheet cassette 77 capable of holding a stack of sheets, and a pickup roller 79 which feeds the sheets one by one from the sheet cassette 77. The sheet fed from the sheet feeding section by the pickup roller 79 is fed to the secondary transfer position TR2 along the sheet guiding member 15 after having a sheet feed timing adjusted by a pair of registration rollers 80.

The secondary transfer roller 121 is provided freely to abut on and move away from the transfer belt 81, and is driven to abut on and move away from the transfer belt 81 by a secondary transfer roller driving mechanism (not shown). The fixing unit 13 includes a heating roller 131 which is freely rotatable and has a heating element such as a halogen heater built therein, and a pressing section 132 which presses this heating roller 131. The sheet having an image secondarily transferred to the front side thereof is guided by the sheet guiding member 15 to a nip portion formed between the heating roller 131 and a pressure belt 1323 of the pressing section 132, and the image is thermally fixed at a specified temperature in this nip portion. The pressing section 132 includes two rollers 1321 and 1322 and the pressure belt 1323 mounted on these rollers. Out of the surface of the pressure belt 1323, a part stretched by the two rollers 1321 and 1322 is pressed against the circumferential surface of the heating roller 131, thereby forming a sufficiently wide nip portion between the heating roller 131 and the pressure belt 1323. The sheet having been subjected to the image fixing operation in this way is transported to the discharge tray 4 provided on the upper surface of the housing main body 3.

Further, a cleaner 71 is disposed facing the blade facing roller 83 in this apparatus. The cleaner 71 includes a cleaner blade 711 and a waste toner box 713. The cleaner blade 711 removes foreign matters such as toner remaining on the transfer belt after the secondary transfer and paper powder by holding the leading end thereof in contact with the blade facing roller 83 via the transfer belt 81. Foreign matters thus removed are collected into the waste toner box 713. Further, the cleaner blade 711 and the waste toner box 713 are constructed integral to the blade facing roller 83. Accordingly, if the blade facing roller 83 moves as described next, the cleaner blade 711 and the waste toner box 713 move together with the blade facing roller 83.

Figure 5:
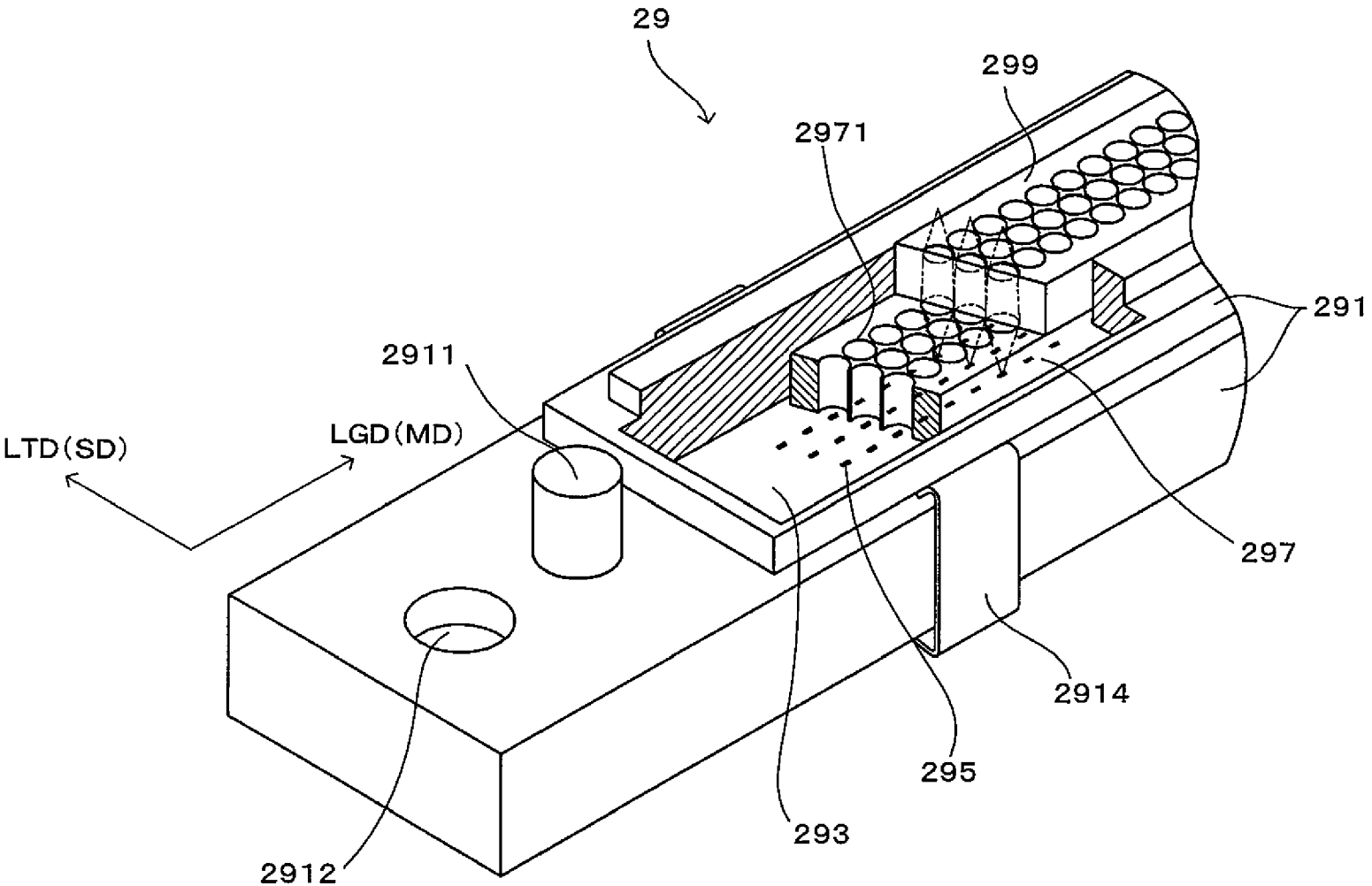
FIG. 5 is a perspective view schematically showing a first embodiment of the line head according to the invention.
Figure 6:
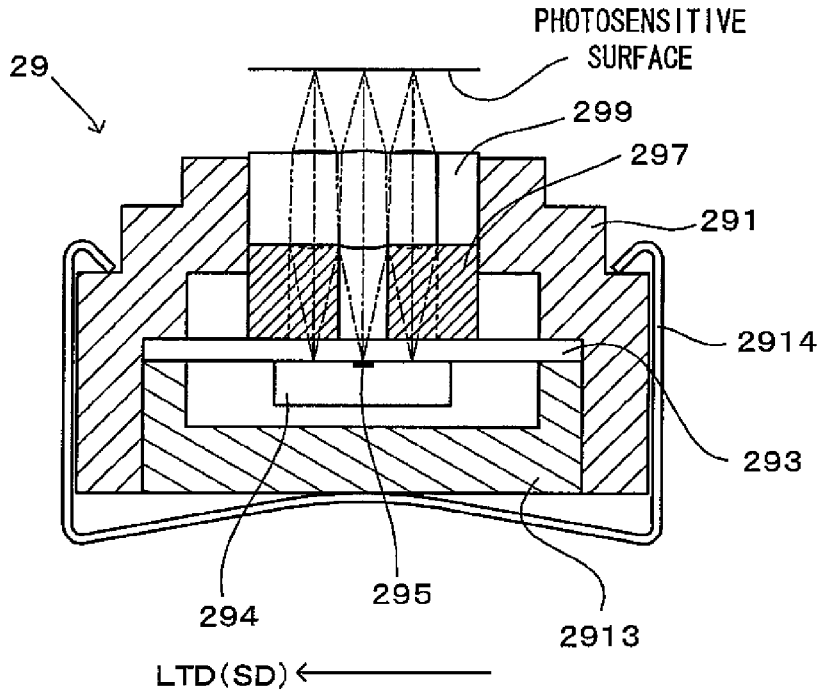
FIG. 6 is a section along width direction of the first embodiment of the line head according to the invention.

FIG. 5 is a perspective view schematically showing a first embodiment of the line head according to the invention, and FIG. 6 is a section along width direction of the first embodiment of the line head according to the invention. In this embodiment, the line head 29 is arranged to face the surface of the photosensitive drum such that the longitudinal direction LGD of the line head 29 is parallel to the main scanning direction MD and the width direction LTD substantially normal to the longitudinal direction LGD is parallel to the sub scanning direction SD. In other words, the main scanning direction MD and the sub scanning direction SD of the photosensitive drum 21 correspond to the longitudinal direction LGD and the width direction LTD of the line head 29 in this embodiment. It should be noted that the longitudinal direction LGD corresponds to a "first direction" of the invention, the width direction LTD to a "second direction" of the invention and the main scanning direction MD to a "direction corresponding to the first direction" of the invention.

The line head 29 includes a case 291 which extends parallel to the longitudinal direction LGD. A positioning pin 2911 and a screw insertion hole 2912 are provided at each of the opposite ends of the case 291. The line head 29 is positioned with respect to the photosensitive drum 21 by fitting the positioning pins 2911 into positioning holes (not shown) formed in a photosensitive drum cover (not shown) which covers the photosensitive drum 21 and is positioned with respect to the photosensitive drum 21. Further, the line head 29 is fixed with respect to the photosensitive drum 21 by screwing fixing screws into screw holes (not shown) of the photosensitive drum cover through the screw insertion holes 2912 to fix.

The case 291 carries a microlens array 299 at a position facing the surface of the photosensitive drum 21, and includes, inside thereof, a light shielding member 297 and a glass substrate 293 in this order closer to the microlens array 299. A plurality of luminous element groups 295 are arranged on the underside surface of the glass substrate 293 (surface opposite to the one where the microlens array 299 is disposed out of two surfaces of the glass substrate 293). Specifically, the plurality of luminous element groups 295 are two-dimensionally (M×N) arranged on the underside surface of the glass substrate 293 while being spaced apart at specified intervals from each other in the longitudinal direction LGD and in the width direction LTD. Here, each of the plurality of luminous element groups 295 is composed of a plurality of two-dimensionally arranged luminous elements, and is described later. In this embodiment, an organic EL (electroluminescence) device of bottom emission type is used as the luminous element. In other words, the organic EL devices are arranged on the underside surface of the glass substrate 293 as the luminous elements. When the respective luminous elements are driven by driving circuits (not shown) formed on this glass substrate 293, light beams are emitted from the luminous elements in a direction toward the photosensitive drum 21. These light beams are headed for the light shielding member 297 via the glass substrate 293. It should be noted that all the luminous elements are structure such that the wavelength of the light beams emitted from the respective luminous elements are equal to each other.

The light shielding member 297 is formed with a plurality of light guiding holes 2971 which are in a one-to-one correspondence with the plurality of luminous element groups 295. Each of the light guiding holes 2971 is in the form of a substantial cylinder whose central axis is parallel to a normal line to the surface of the glass substrate 293, and penetrates the light shielding member 297. Thus, all the light beams emitted from the luminous elements belonging to one luminous element group 295 are headed for the microlens array 299 via the same light guiding hole 2971, and the interference of light beams emitted from different luminous element groups 295 is prevented by means of the light shielding member 297. The light beams having passed through the light guiding holes 2971 formed in the light shielding member 297 are imaged as spots on the surface of the photosensitive drum 21 by means of the microlens array 299. It should be noted that the specific construction of the microlens array 299 and the imaged state of the light beams by the microlens array 299 are described in detail later.

As shown in FIG. 6, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction of the case 291. The luminous element groups 295 are covered with a sealing member 294.

Figure 7:
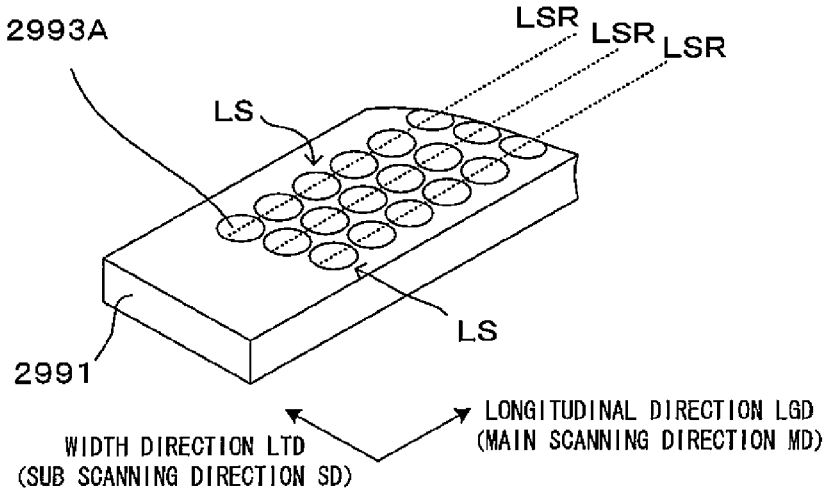
FIG. 7 is a perspective view schematically showing the microlens array.
Figure 8:
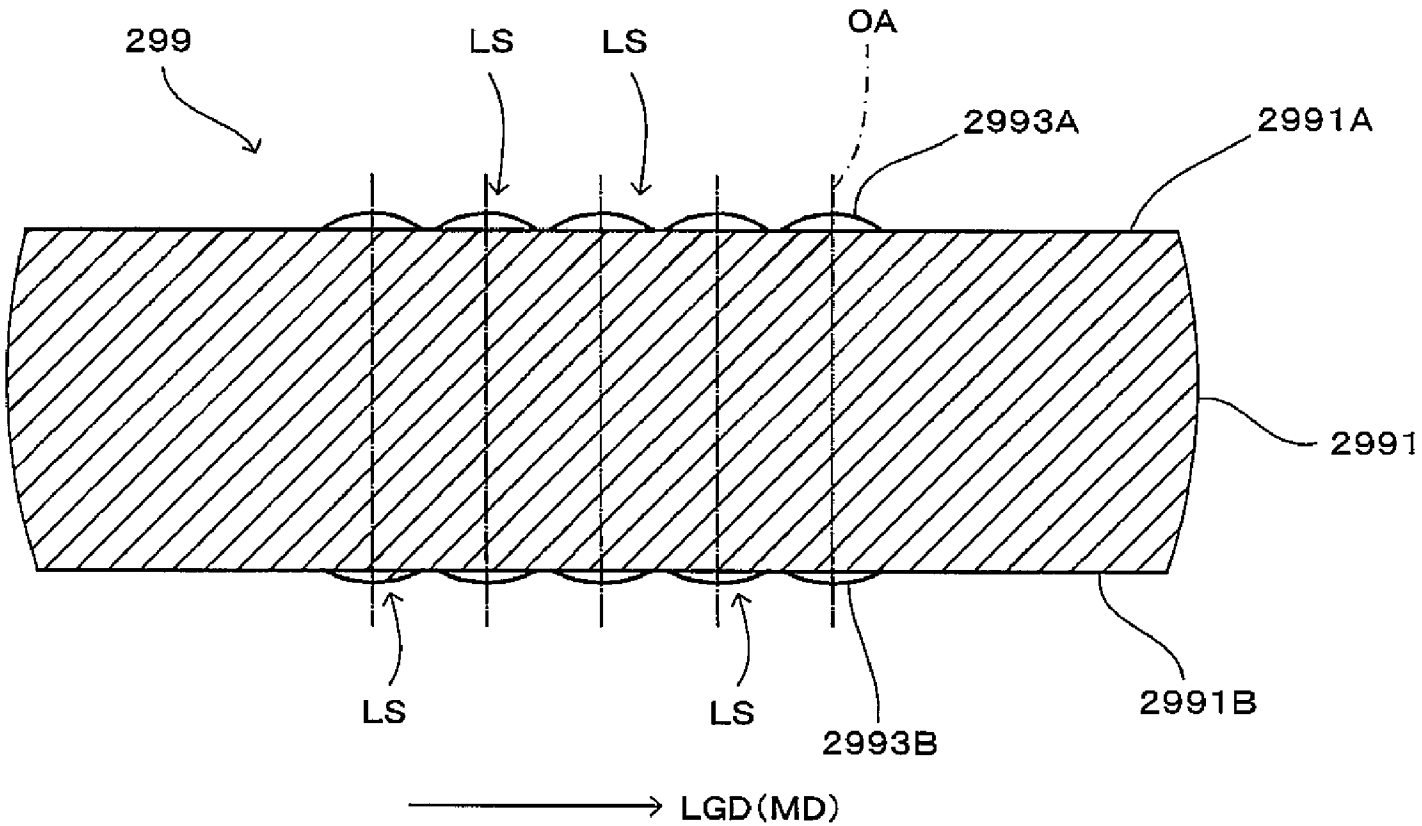
FIG. 8 is a longitudinal section of the microlens array.

FIG. 7 is a perspective view schematically showing the microlens array, and FIG. 8 is a longitudinal section of the microlens array. The microlens array 299 includes a glass substrate 2991 and a plurality of lens pairs each comprised of two lenses 2993A and 2993B arranged in one-to-one correspondence at the opposite sides of the glass substrate 2991. These lenses 2993A and 2993B can be formed of resin for instance.

Specifically, a plurality of lenses 2993A are arranged on a top surface 2991A of the glass substrate 2991, and a plurality of lenses 2993B are so arranged on an underside surface 2991B of the glass substrate 2991 as to correspond one-to-one to the plurality of lenses 2993A. Further, two lenses 2993A and 2993B constituting a lens pair have a common optical axis OA. These plurality of lens pairs are arranged in a one-to-one correspondence with the plurality of luminous element groups 295. Specifically, the plurality of lens pairs are two-dimensionally (M×N) arranged and spaced apart from each other at specified intervals in the longitudinal direction LGD and in the width direction LTD corresponding to the arrangement of the luminous element groups 295. More specifically, in this microlens array 299, a micro lens LS including the lens pair comprised of the lenses 2993A and 2993B and the glass substrate 2991 located between the lens pair corresponds to a "lens" of the invention. A plurality of (three in this embodiment) lens rows LSR, each of which is comprised of a plurality of these microlenses LS aligned in the longitudinal direction LGD, are arranged in the width direction LTD, thereby arranging a plurality of microlenses LS in a staggered arrangement and at positions different from each other in the longitudinal direction. Particularly in this embodiment, microlenses LS are arranged such that a distance P between the optical axes in the longitudinal direction LGD are constant (FIG. 7). Further, all the microlenses LS are structured identically and have the same magnification m. Meanwhile, although the microlenses LS having the magnification m whose value is negative are used in this embodiment, the magnification m may be set to a positive value, needless to say.

Figure 9:
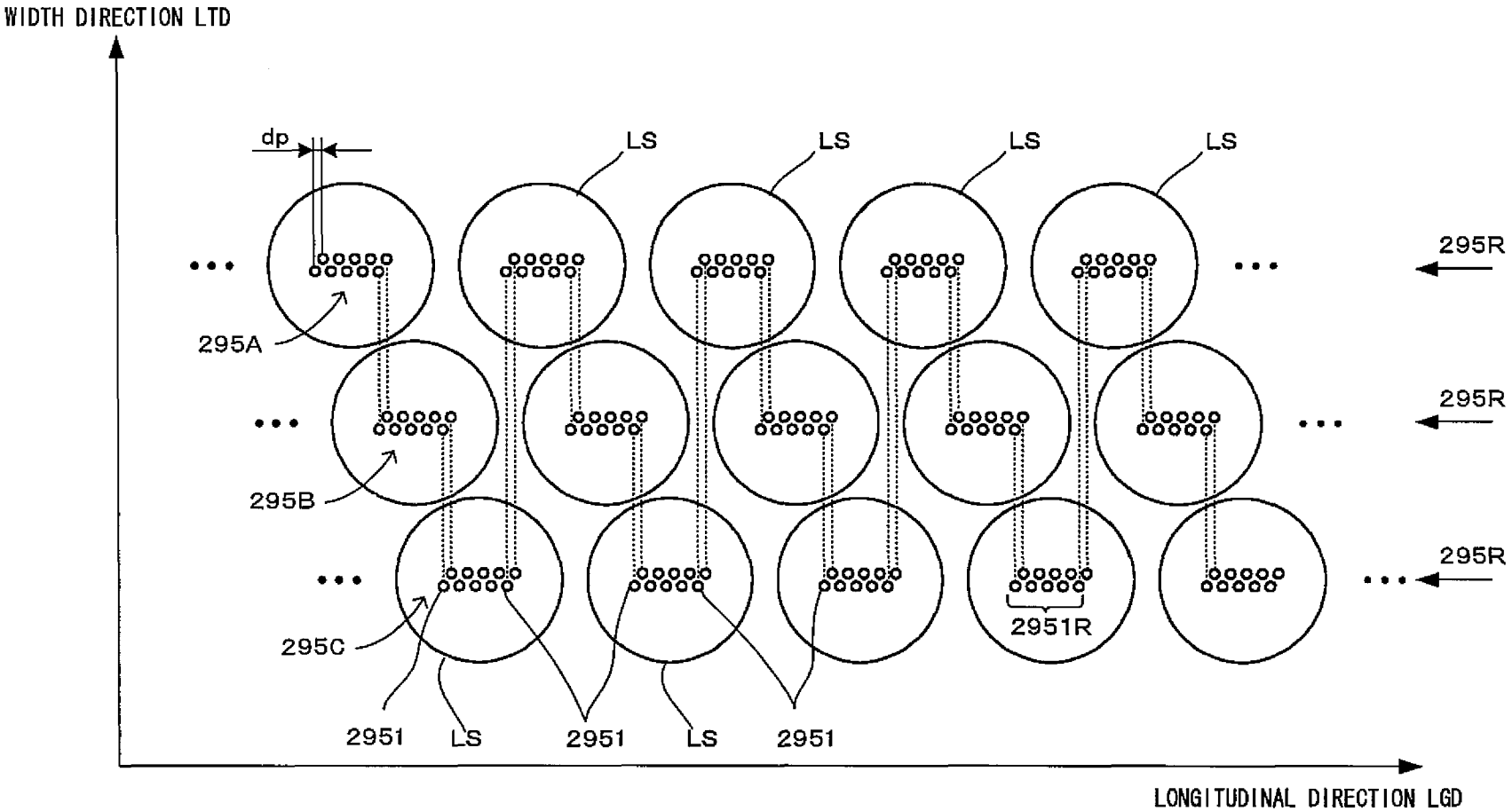
FIG. 9 is a diagram showing the arrangement relationship of the luminous element groups and the microlenses in the line head.

FIG. 9 is a diagram showing the arrangement relationship of the luminous element groups and the microlenses in the line head. In this line head, a plurality of luminous element groups 295 having the same construction are arranged in one-to-one correspondence relationship with the microlenses LS arranged as described above. Specifically, the luminous element group row 295R is formed by aligning a specified number of luminous element groups 295 while spacing them apart from each other in the longitudinal direction LGD. A plurality of ("three" in this embodiment) luminous element group rows 295R are arranged in the width direction LTD, wherein a plurality of luminous element groups 295 are arranged in a staggered manner. A spacing between the adjacent luminous element groups 295 in the longitudinal direction LGD coincides with a distance P between optical axes of the microlenses LS.

Each luminous element group 295 includes ten luminous elements 2951, which are arranged as follows. Specifically, in each luminous element group 295, five luminous elements 2951 are aligned at specified pitches (=twice the element pitch dp) in the longitudinal direction LGD to form the luminous element row 2951R. Further, two luminous element rows 2951R are arranged in the width direction LTD. Furthermore, a shift amount of the luminous element rows 2951R in the longitudinal direction LGD is the element pitch dp (=Pel). Thus, in each luminous element group 295, all the luminous elements 2951 are arranged at mutually different longitudinal positions spaced apart by the element pitch dp. Accordingly, light beams emitted from the ten luminous elements 2951 in each luminous element group 295 are focused on the surface of the photosensitive drum 21 (hereinafter, "photosensitive surface") at mutually different positions in the main scanning direction MD by the microlens LS. In this way, ten spots are formed side by side in the main scanning direction MD to form a spot group.

Further, in this embodiment, the line head 29 is constructed such that the spot groups formed adjacent to each other in the main scanning direction MD partly overlap each other. Particularly in this embodiment, the magnification m of the microlenses LS is set at (−1) and the opposite ends of each luminous element group 295 overlap with the ends of the adjacent luminous element groups 295 in the longitudinal direction LGD. Here, attention is paid to three luminous element groups 259A to 259C adjacent in the longitudinal direction LGD to describe the above arrangement relationship in detail with reference to FIG. 9. The luminous element group 295A is located upstream (to the left in FIG. 9) of the luminous element group 295B, whereas the luminous element group 295C is located downstream (to the right in FIG. 9) of the luminous element group 295B. As shown by broken lines of FIG. 9, out of the ten luminous elements 2951 constituting the luminous element group 295B, the two at the most upstream side are arranged to overlap with the two located at the downstream end of the luminous element group 295A in the longitudinal direction LGD. On the other hand, the two at the most downstream side are arranged to overlap with the two luminous elements located at the upstream end of the luminous element group 295C.

Figure 10:
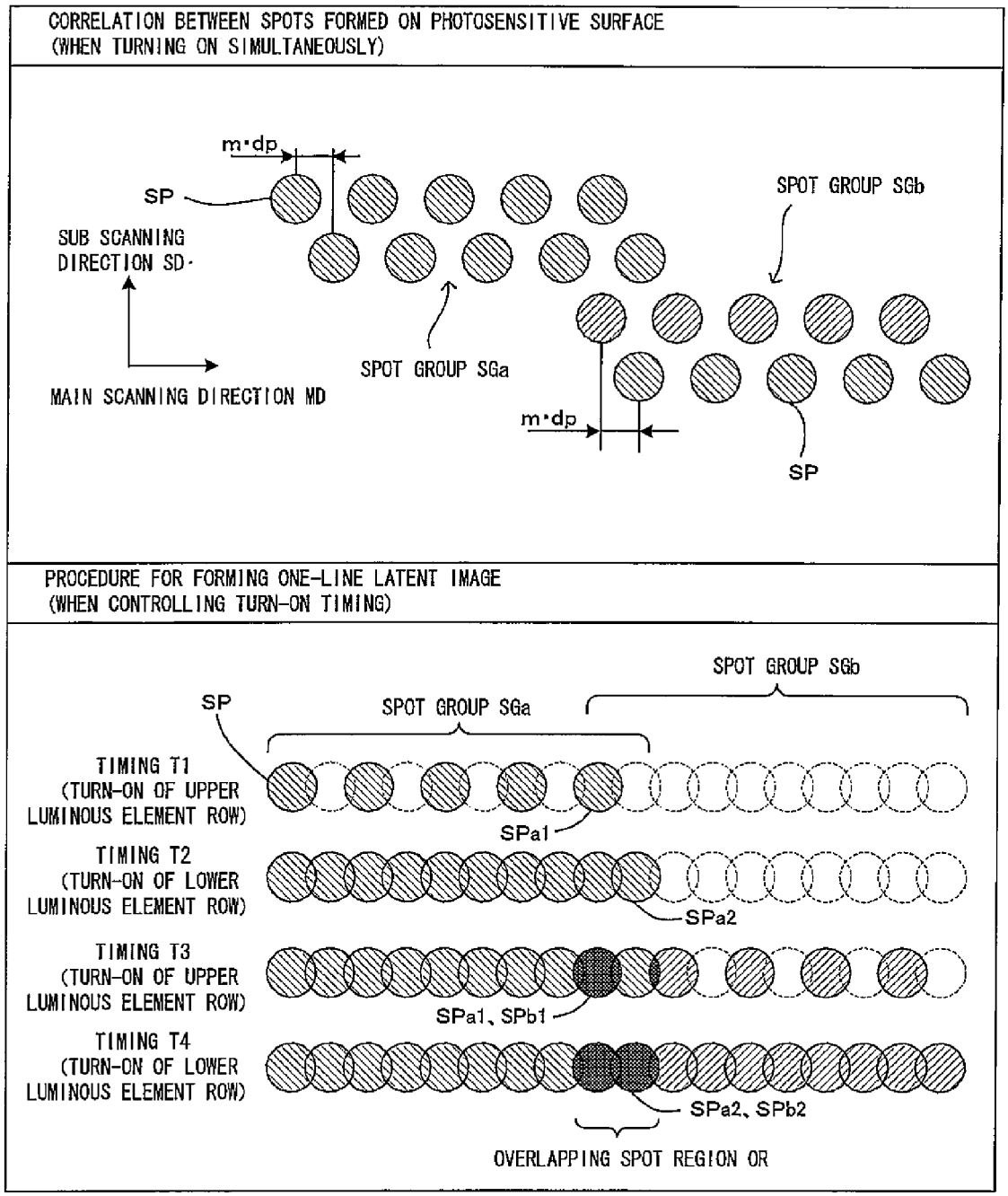
FIG. 10 is a diagram showing the positions of spots formed on the photosensitive surface by the line head.

FIG. 10 is a diagram showing the positions of spots formed on the photosensitive surface by the line head, and diagrammatically shows a state where spots are formed by two luminous element groups, for example the luminous element groups 295A and 295B in FIG. 9. A "spot group SGa" in FIG. 10 represents a group of spots SP formed by the luminous element group 295A at the upstream side (left side in FIG. 9), whereas a "spot group SGb" represents a group of spots SP formed by the luminous element group 295B at the downstream side (right side in FIG. 9). As shown in an upper part of FIG. 10, if the luminous elements 2951 are simultaneously turned on, the spot groups Sga and SGb formed on the photosensitive surface are also two-dimensionally arranged.

Accordingly, in this embodiment, the luminous elements 2951 constituting the luminous element row 2951R are turned on to emit light beams at timings in conformity with a rotational movement of the photosensitive drum 21 in each luminous element row 2951R as shown in a lower part of FIG. 10. In other words, the turn-on timings of the luminous element rows 2951R constituting the luminous element groups 295A and 295B are differentiated as follows in conformity with the rotational movement of the photosensitive drum 21.

(a) Timing T1: Turn the upper luminous element row 2951R of the luminous element group 295A on (b) Timing T2: Turn the lower luminous element row 2951R of the luminous element group 295A on (c) Timing T3: Turn the upper luminous element row 2951R of the luminous element group 295B on (d) Timing T4: Turn the lower luminous element row 2951R of the luminous element group 295A on Thus, the spots SP formed by the upper luminous element rows and those formed by the lower luminous element rows can be aligned in the main scanning direction MD only by this timing adjustment. In this way, the spots SP can be aligned in a line in the main scanning direction MD by a simple emission timing adjustment.

Here, what should be further noted is that the spot groups Sga and SGb formed adjacent to each other in the main scanning direction MD partly overlap to form an overlapping spot region OR in this embodiment. Specifically, in this overlapping spot region OR, some (spots SPa1 and SPa2 in FIG.

10) of the spots by the luminous element group 295A and some (spots SPb1 and SPb2 in FIG. 10) of the spots by the luminous element group 295B overlap. In this specification, the spots SPa1, SPa2, SPb1 and SPb2 forming the overlapping spot region OR are called "overlapping spots".

If exposure is made to the photosensitive surface using the line head 29 constructed as above, a two-dimensional latent image L1 as shown in FIGS. 11A and 11B is obtained. Specifically, the spot groups adjacent to each other form overlapping spot regions OR by partly overlapping. Thus, the formation of clearances between the spot groups SG can be prevented and good spot formation can be carried out, not only when there are neither displacements nor magnification errors (FIG. 11A), but also when the relative positional relationship of the luminous element groups 295 and the microlenses LS is slightly deviated or there are magnification errors of the microlenses LS (FIG. 11B). Further, by forming an image using such a line head 29, a high-quality toner image can be formed without generating vertical lines.

FIG. 12 is a diagram showing a comparative example of the line head, and FIGS. 13A, 13B, 14A and 14B are diagrams showing a state of spots formed by the comparative example of FIG. 12. Here, functions and effects brought about by adopting the above construction are described with reference to FIGS. 12, 13A, 13B, 14A and 14B.

In this comparative example, as shown in a lower part of FIG. 12, four luminous elements 2951 are aligned at specified pitches (=twice the element pitch dp) in the longitudinal direction LGD to form the luminous element row 2951R in each luminous element group 295. Further, two luminous element rows 2951R are arranged in the width direction LTD. Further, the luminous element rows 2951R are shifted from each other by the element pitch dp in the longitudinal direction LGD. In the comparative example, when the luminous elements 2951 are turned on, all the spots SP are formed at mutually different positions in the main scanning direction MD while being spaced apart by a spot pitch (m dp) as is clear from an upper part of FIG. 12.

Accordingly, if the spots SP are formed on the photosensitive surface by the line head according to the comparative example, the adjacent spot groups are continuously connected and good spot formation is carried out if there are neither displacements nor magnification errors (see FIGS. 13A and 14A). However, if the mutual positional relationship of the luminous element groups 295 and the microlenses LS is slightly deviated to cause a displacement, spot groups SG1 and SG2 are separated from each other to form a vertical line as shown in FIG. 13B. Also in the case of a magnification error in the microlens array 299, spot groups SG1 to SG3 are separated from each other to form vertical lines as shown in FIG. 14B.

On the contrary, the line head 29 is so constructed as to form the overlapping spot regions OR according to this embodiment as described above. Thus, spots can be formed without causing these problems. In an image forming apparatus using thus constructed line head 29 as an exposing device, high-quality images can be formed.

C. Second Embodiment

Since angle of view of the microlenses LS regarding light beams from the luminous elements 2951 located at the ends of the luminous element groups 295 is large, there are cases where the diameter of the spots SP increases and light quantity decrease due to an aberration deterioration of the microlenses LS. If such a problem needs to be considered, it is preferable to construct the respective luminous element groups 295 as follows.

Figure 15:
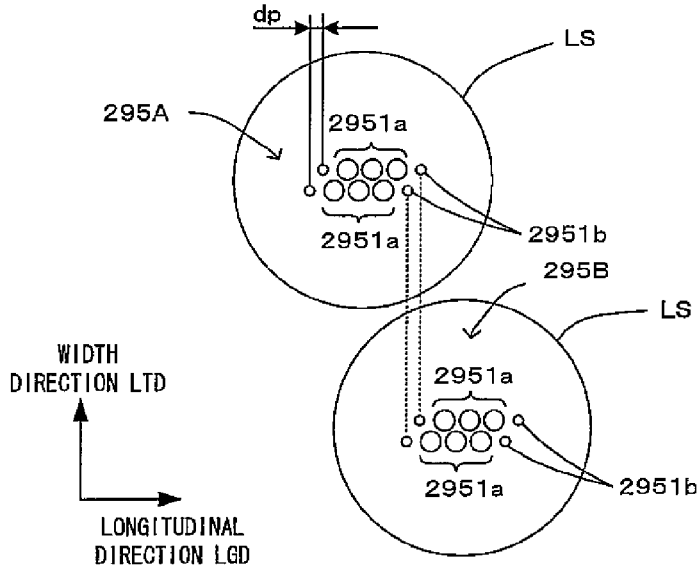
FIG. 15 is a diagram showing a second embodiment of the line head according to the invention.

FIG. 15 is a diagram showing a second embodiment of the line head according to the invention. In this embodiment, luminous elements constituting each luminous element group 295 are divided into two types of luminous elements different from each other. One type are luminous elements 2951*b* located at the ends of the luminous element groups 295 to form overlapping spots, and the other type are remaining luminous elements 2951*a*, which respectively form independent spots. In this embodiment, the element diameter of the luminous elements 2951*b* is smaller than that of the luminous elements 2951*a*.

In the case of using the luminous element groups 295 constructed as above, the diameter of spots formed by the luminous elements 2951*b*, that is, that of overlapping spots, increases due to the aberration deterioration of the microlenses LS. Thus, the diameter of the overlapping spots becomes substantially the same as that of spots SP formed by the luminous elements 2951*a*, whereby the spot diameters can be made uniform. By making the element diameter of the respective luminous elements 2951*b* smaller, the light quantities of the respective overlapping spots decrease. However, in an overlapping spot region OR, overlapping spots formed by the luminous elements 2951*b* of the luminous element groups adjacent to each other in the longitudinal direction LGD (luminous element groups 295A and 295B in FIG. 15 for instance), that is, by two luminous elements 2951*b* overlap. Thus, about the same light quantity as the spots SP formed by the luminous elements 2951*a* can be obtained. Therefore, light quantity reductions caused by the aberration deterioration of the microlenses LS can be solved.

As described above, according to the line head of this embodiment, the spot diameters and the light quantities can be made uniform even if the aberration of the microlenses LS is deteriorated. Further, it becomes unnecessary to require strict optical characteristics for the design of the microlenses LS, a relatively large degree of freedom in designing can be obtained and the cost of the microlens array 299 can be reduced. It should be noted that such a construction is also applicable to devices for forming overlapping spot regions OR and overlapping regions WR in fifth to eighth embodiments to be described in detail later and that similar functions and effects are obtained.

D. Third Embodiment

The following construction is preferable for a problem that light quantity in the overlapping spot regions OR is larger than that in other regions. This is described below with reference to FIG. 16.

Figure 16:
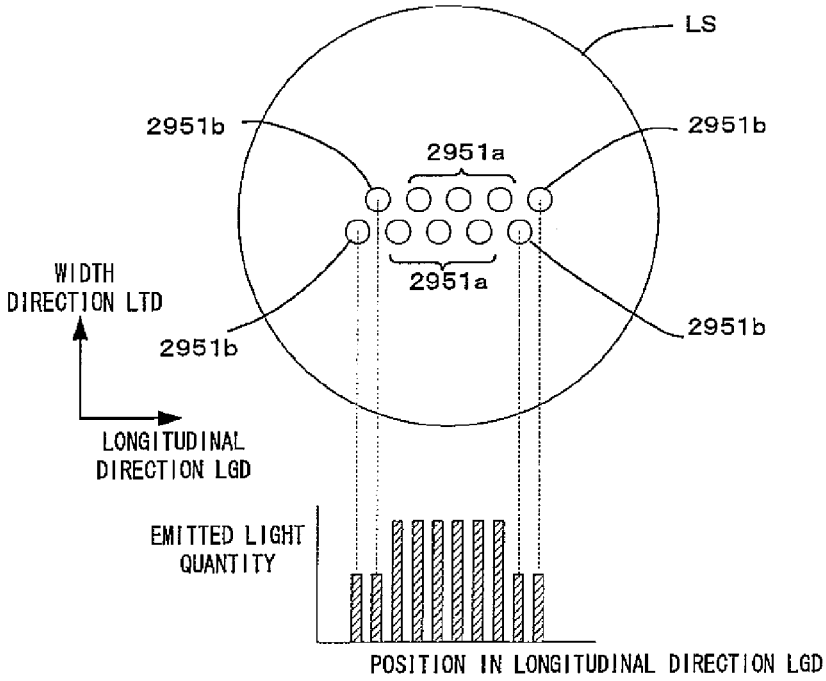
FIG. 16 is a diagram showing another embodiment of the line head according to the invention.

FIG. 16 is a diagram showing another embodiment of the line head according to the invention. In this embodiment as well, each luminous element group 295 includes luminous elements 2951*b* for forming overlapping spots and luminous elements 2951*a* for forming independent spots similar to the embodiment shown in FIG. 15. Further, in this embodiment, the emitted light quantity of the luminous elements 2951*b* is smaller than that of the luminous elements 2951*a*. Accordingly, in the overlapping spot region OR, overlapping spots are formed by two luminous elements 2951*b* and the light quantity in the overlapping spot region OR is about the same as that in the other region (region where spots are formed by the luminous elements 2951*a*). Thus, even if the overlapping spot regions OR are provided, the light quantities on the photosensitive surface can be made uniform. It should be noted that such a construction is also applicable to devices for forming the overlapping spot regions OR and overlapping regions WR in the fifth to eighth embodiments to be described in detail later and that similar functions and effects are obtained.

Figure 17:
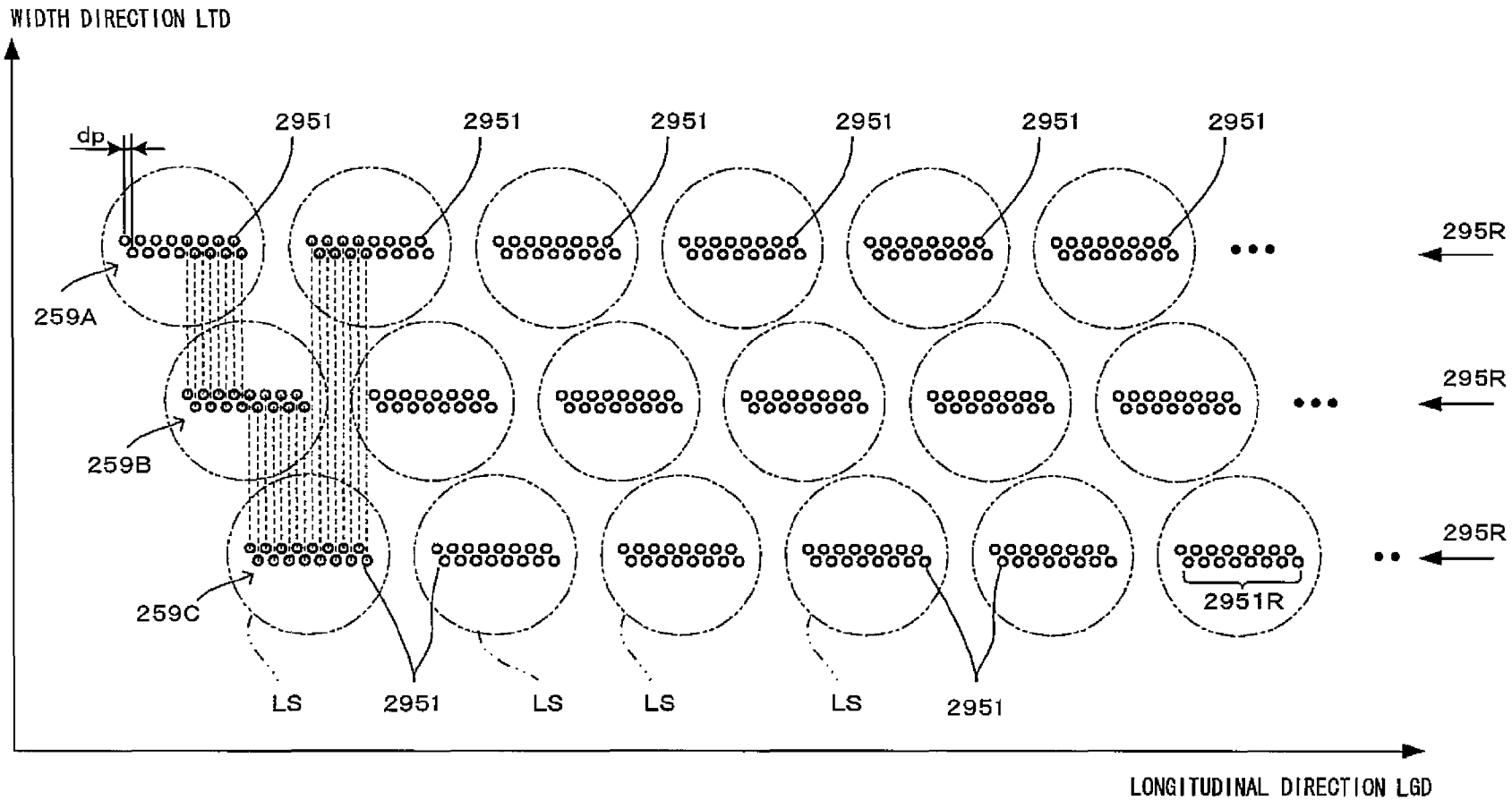
FIG. 17 is a diagram showing a third embodiment of the line head according to the invention.

Although some of the luminous elements constituting the luminous element groups 295 function as luminous elements for forming the overlapping spots in the above embodiments, all the luminous elements may function as luminous elements for forming overlapping spots as shown in FIG. 17.

FIG. 17 is a diagram showing a third embodiment of the line head according to the invention. In this embodiment, each luminous element group 295 includes sixteen luminous elements 2951. More specifically, in each luminous element group 295, eight luminous elements 2951 are aligned at specified pitches (=twice the element pitch dp) in the longitudinal direction LGD to form a luminous element row 2951R. Further, two luminous element rows 2951R are arranged in the width direction LTD. Furthermore, a shift amount of the luminous element rows 2951R in the longitudinal direction LGD is the element pitch dp. Thus, in each luminous element group 295, all the luminous elements 2951 are arranged at mutually different longitudinal positions spaced apart by the element pitch dp. In this embodiment, all the luminous elements 2951 form overlapping spots by an operation as shown in FIG. 18.

Figure 18:
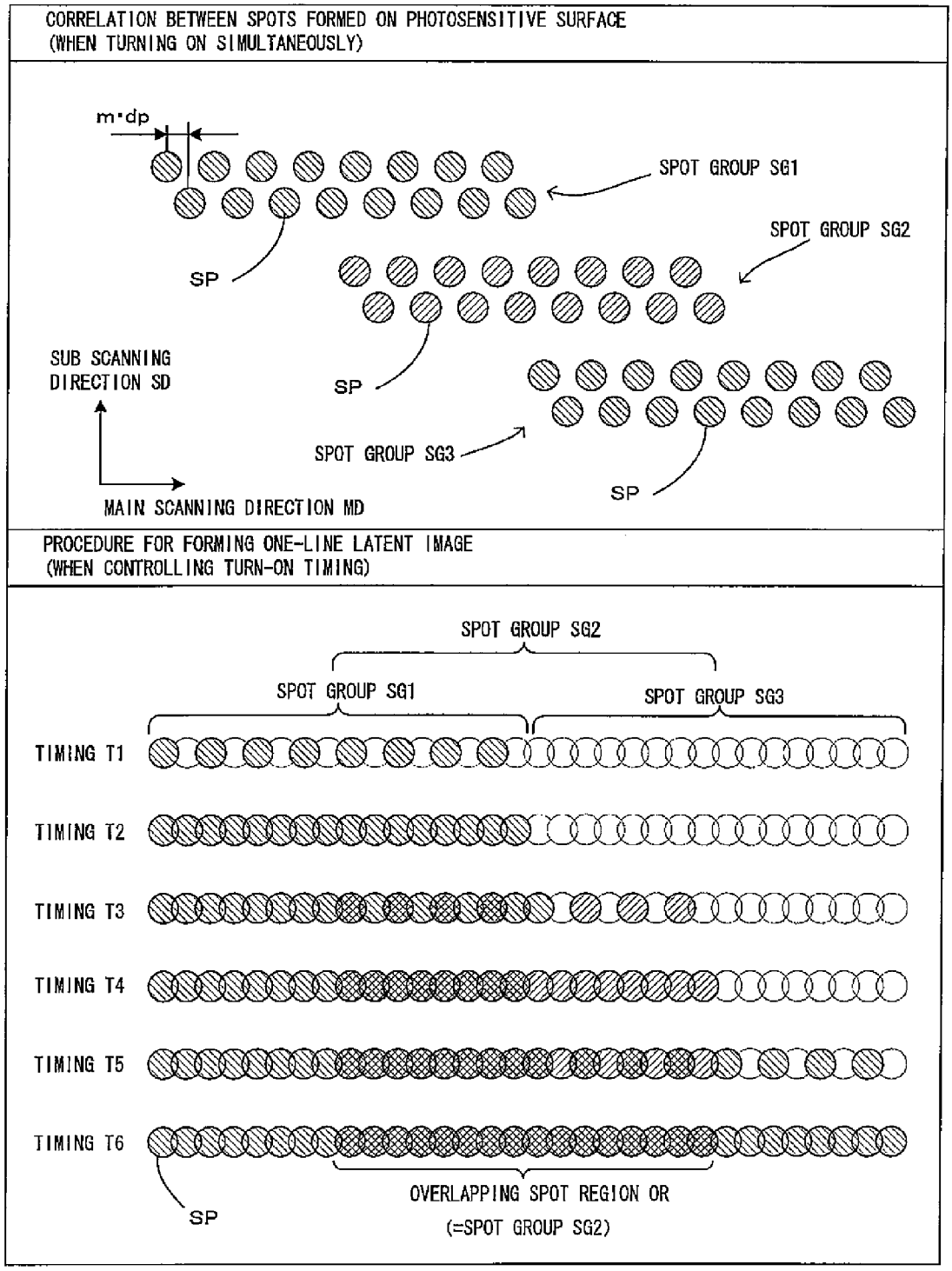
FIG. 18 is a diagram showing the positions of spots formed on the photosensitive surface by the line head of FIG. 17.

FIG. 18 is a diagram showing the positions of spots formed on the photosensitive surface by the line head of FIG. 17. In FIG. 18 are shown spots SP formed by three luminous element groups 295A to 295C shown in FIG. 17. These three luminous element groups 295A to 295C are provided in correspondence with three microlenses LS adjacent to each other and are also adjacent to each other in the longitudinal direction LGD as shown in FIG. 17. Thus, the luminous element groups 295A, 295B and 295C correspond to an "upstream luminous element group", a "middle luminous element group" and a "downstream luminous element group" of the invention, respectively.

Each luminous element row 2951R is constructed such that the luminous elements 2951 constituting the luminous element row 2951R are turned on to emit light beams at timings in conformity with a rotational movement of the photosensitive drum 21. In other words, the turn-on timings of the luminous element rows 2951R constituting the luminous element groups 295A to 295C are differentiated as follows in conformity with the rotational movement of the photosensitive drum 21.

(a) Timing T1: Turn the upper luminous element row 2951R of the luminous element group 295A on (b) Timing T2: Turn the lower luminous element row 2951R of the luminous element group 295A on (c) Timing T3: Turn the upper luminous element row 2951R of the luminous element group 295B on (d) Timing T4: Turn the lower luminous element row 2951R of the luminous element group 295B on (e) Timing T5: Turn the upper luminous element row 2951R of the luminous element group 295C on (f) Timing T6: Turn the lower luminous element row 2951R of the luminous element group 295C on Thus, the spots SP formed by the upper luminous element rows and those formed by the lower luminous element rows can be aligned in the main scanning direction MD only by this timing adjustment. In this way, the spots SP can be aligned in a line in the main scanning direction MD by a simple emission timing adjustment. Further, the overlapping spot region OR formed in this way coincides with the spot region by the luminous element group 295B. Furthermore, in this embodiment, the overlapping spot region OR becomes wider as compared to the first embodiment and the like, whereby the formation of vertical lines can be reliably prevented even in the case of larger displacements and magnification errors. It should be noted that such a construction is also applicable to devices for forming the overlapping spot regions OR and overlapping regions WR in the fifth to eighth embodiments to be described in detail later and that similar functions and effects are obtained.

E. Fourth Embodiment

Figure 19:
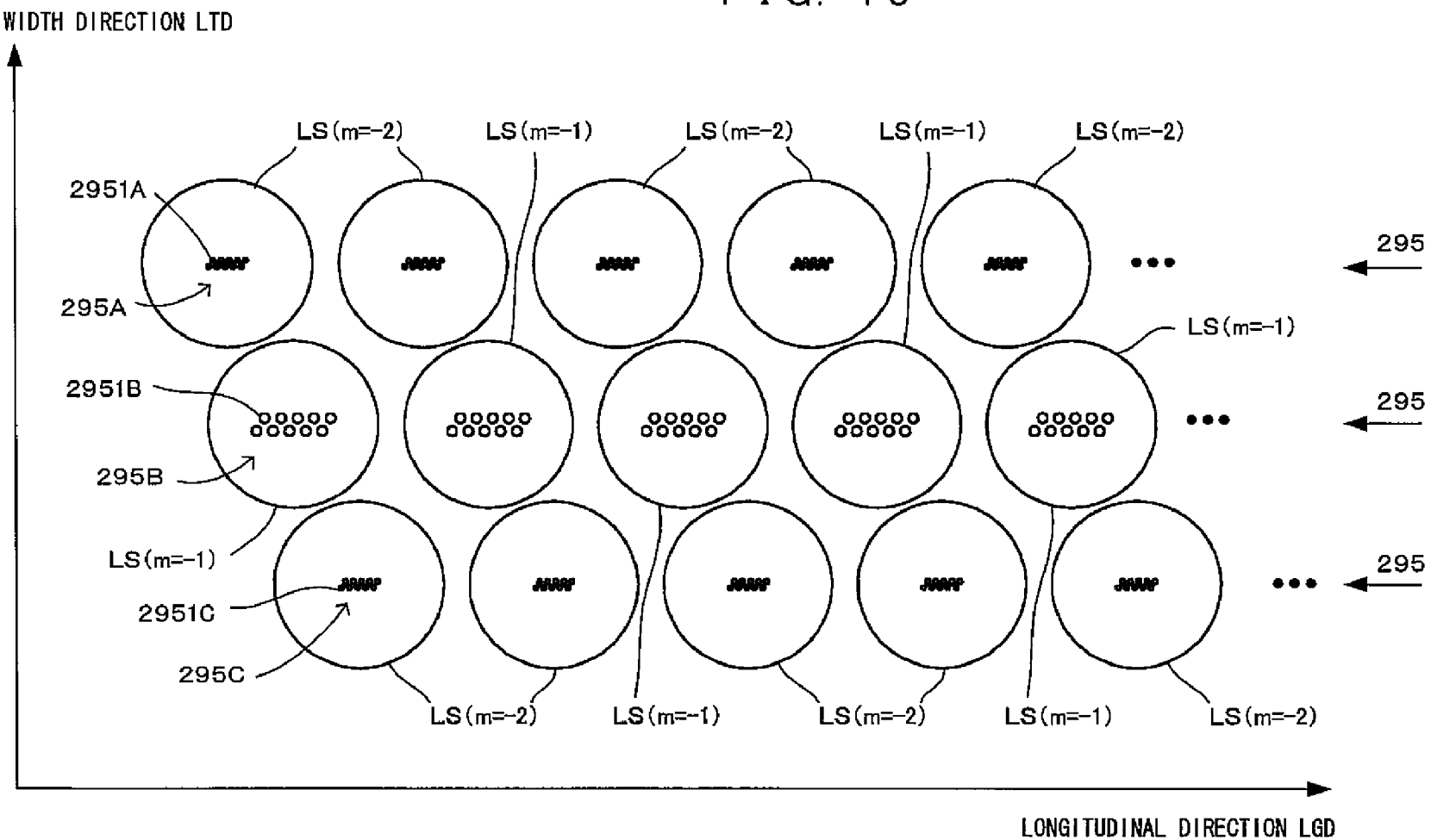
FIG. 19 is a diagram showing a fourth embodiment of the line head according to the invention.

In the above embodiments, the luminous element groups 295 are identically constructed and the microlenses LS are also identically constructed. However, magnification may be differentiated for each microlens LS as shown in FIG. 19, for example. In the embodiment shown in FIG. 19, the magnification m of the microlenses LS in the uppermost and bottommost rows with respect to the width direction LTD are set at "−2", whereas the magnification m of the microlenses LS in the middle row is set at "−1" (magnification m is shown in parentheses in FIG. 19) The microlenses LS having mutually different magnifications m may be provided in this way, and functions and effects similar to the above embodiments can be obtained by forming overlapping spot regions also in this line head. Further, the magnification m of the microlenses LS can be arbitrarily set in this way. As a result, a degree of freedom in designing can be improved. For example, a space suitable for the layout of wiring formed on a glass substrate 293 can be easily ensured. In the case of changing the magnification m for each microlens LS, it is desirable to change the diameters of the luminous elements 2951 in view of the magnification m as shown in FIG. 19. In other words, it is desirable to increase the element diameter as the absolute value of the magnification m decreases. This is for making the spot diameters on the photosensitive surface uniform. It should be noted that such a construction is also applicable to devices for forming the overlapping spot regions OR and overlapping regions WR in the fifth to eighth embodiments to be described in detail later and that similar functions and effects are obtained.

F. Fifth Embodiment

Although the overlapping spot regions OR are formed for all the combinations of the spot groups SG adjacent to each other in the above embodiments, the overlapping spot regions OR may be formed only for the combinations whose displacements and the like are particularly problematic. For example, in the case of using a combination of a plurality of lens substrates having lenses as a lens array, lens pairs paired at the opposite sides of the combined positions of the lens substrates are relatively displaced due to assembling errors of the lens substrates and the like in some cases. If a pair of lenses for forming spot groups adjacent to each other in the longitudinal direction LGD are relatively displaced out of these lens pairs, a clearance is formed between the spot groups SG. Accordingly, in a line head and an image forming apparatus adopting such a lens array, it is desirable to form the overlapping spot region OR such that an inter-lens distance Pi of the lenses constituting this lens pair satisfies a relational expression (1) to be described later. This is described below with reference to FIGS. 20 to 30.

Figure 20:
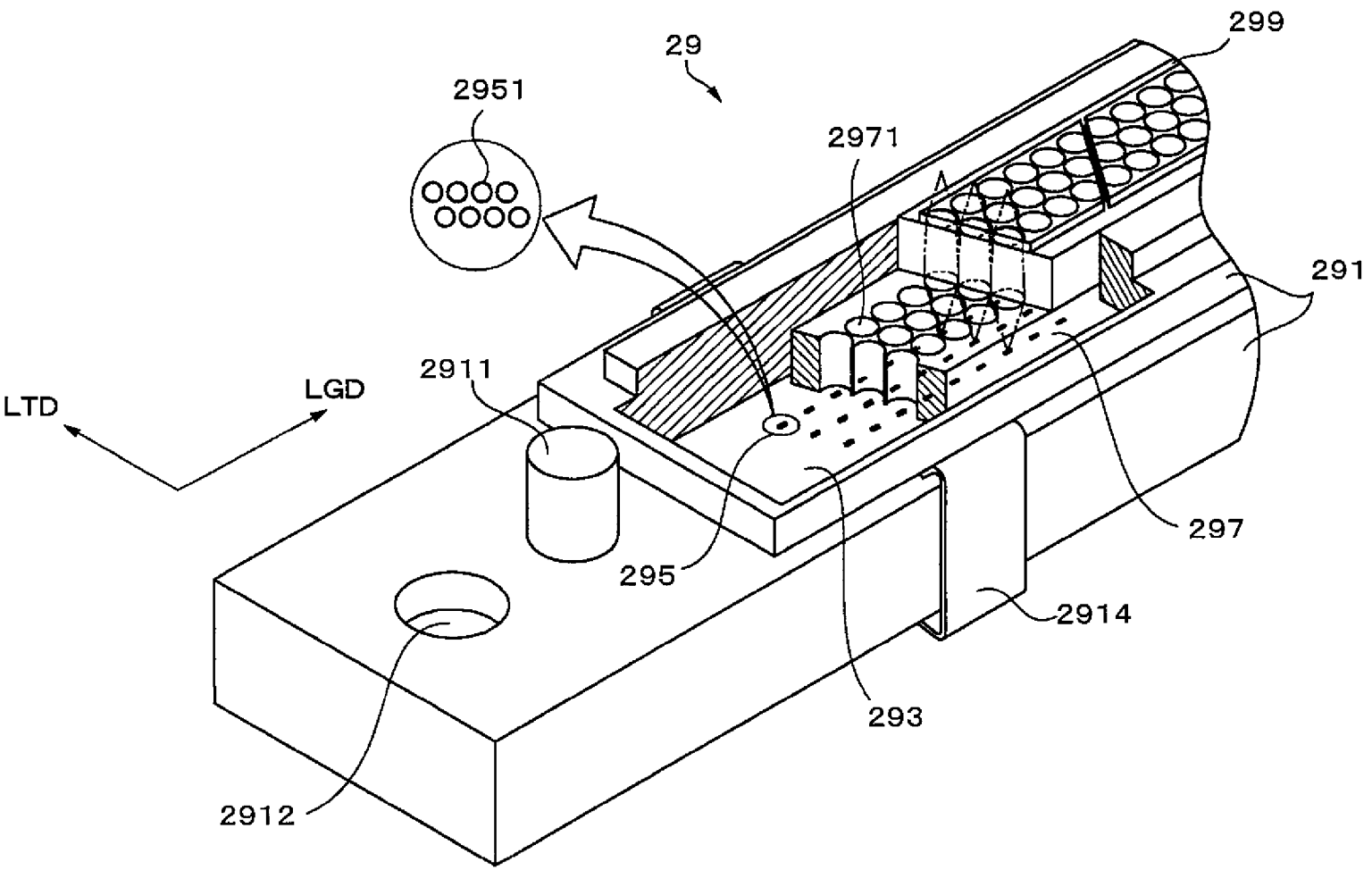
FIG. 20 is a perspective view schematically showing a fifth embodiment of the line head according to the invention.
Figure 21:
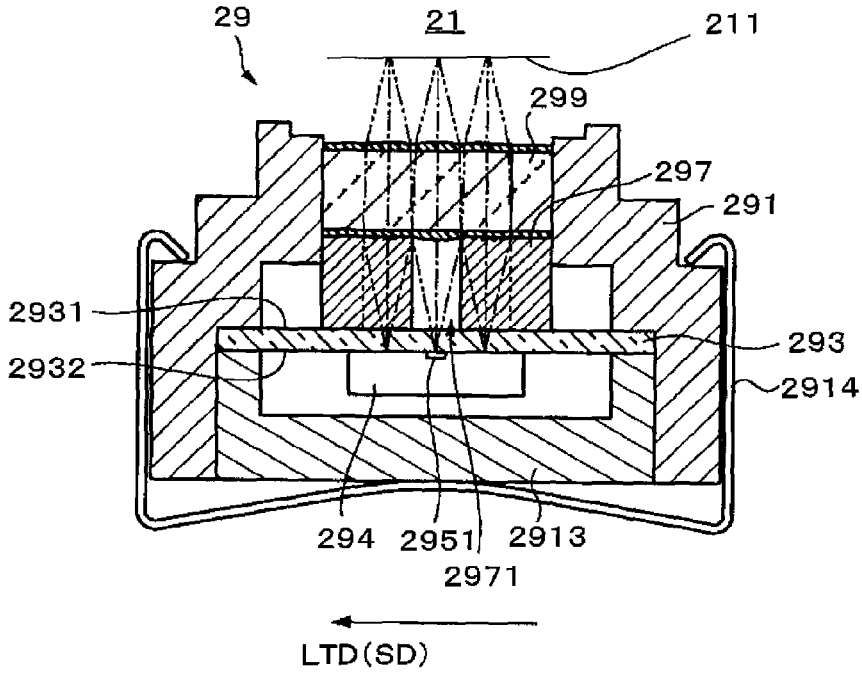
FIG. 21 is a section along the width direction of the fifth embodiment of the line head according to the invention.

FIG. 20 is a perspective view schematically showing a fifth embodiment of the line head according to the invention, and FIG. 21 is a section along the width direction of the fifth embodiment of the line head according to the invention. In this embodiment, a line head 29 is arranged relative to the photosensitive surface such that the longitudinal direction LGD is substantially parallel to the main scanning direction MD and the width direction LTD substantially normal to the longitudinal direction LGD is parallel to the sub scanning direction SD. Specifically, in this embodiment, the main scanning direction MD and the sub scanning direction SD of the photosensitive drum 21 correspond to the longitudinal direction LGD and the width direction LTD of the line head 29, respectively. The line head 29 of this embodiment differs from that of the first embodiment in the following two points. The first point is to adopt a split lens configuration in which a plurality of lens substrates are combined. The second point is that spot groups adjacent to each other in the main scanning direction MD are formed on the photosensitive surface (image plane) so as to overlap in the sub scanning direction SD by lenses paired at the opposite sides of the combined positions of the lens substrates. Since the other construction is the same as in the first embodiment, description is centered on points of difference.

In FIG. 20, the line head 29 includes a case 291 whose longitudinal direction is a direction parallel to the main scanning direction MD, and a positioning pin 2911 and a screw insertion hole 2912 are provided at each of the opposite ends of the case 291. The line head 29 is positioned relative to the photosensitive drum 21 shown in FIG. 3 by fitting the positioning pins 2911 into positioning holes perforated in an unillustrated photosensitive drum cover. The photosensitive drum cover covers the photosensitive drum 21 and is positioned relative to the photosensitive drum 21. Further, the line head 29 is positioned and fixed relative to the photosensitive drum 21 by screwing fixing screws into screw holes (not shown) of the photosensitive drum cover via the screw insertion holes 2912 to be fixed.

In FIGS. 20 and 21, the case 291 carries a microlens array 299 in which imaging lenses are arrayed at positions facing a surface 211 of the photosensitive drum 217 and includes a shielding member 297 and a head substrate 293 as a substrate inside, the shielding member 297 being closer to the microlens array 299 than the head substrate 293. The head substrate 293 is a transparent glass substrate. Further, a plurality of luminous element groups 295 are provided on an under surface 2932 of the head substrate 293 (surface opposite to a top surface 2931 facing the shielding member 297 out of two surfaces of the head substrate 293). The plurality of luminous element groups 295 are two-dimensionally, discretely arranged on the under surface 2932 of the head substrate 293 while being spaced by specified distances in the longitudinal direction LGD and in the width direction LTD as shown in FIG. 20. Here, each luminous element group 295 is formed by two-dimensionally arraying a plurality of luminous elements 2951 as shown in a section circled in FIG. 20. The arrangement of these is described in detail later.

In this embodiment, organic ELs are used as the luminous elements. Specifically, in this embodiment, organic ELs are arranged as the luminous elements 2951 on the under surface 2932 of the head substrate 293. Light beams emitted from the plurality of luminous elements 2951 in a direction toward the photosensitive drum 21 propagate toward the shielding member 297 via the head substrate 293. In this embodiment, all the luminous elements are constructed such that the wavelengths of light beams emitted therefrom are equal to each other. Although the organic ELs are used as the luminous elements 2951, the specific construction of the luminous elements 2951 is not limited to this and, for example, LEDs (light emitting diodes) may be used as the luminous elements 2951. In this case, the substrate 293 may not be a glass substrate and the LEDs may be provided on the top surface 2931 of the substrate 293.

In FIGS. 20 and 21, the shielding member 297 includes a plurality of light guiding holes 2971 in one-to-one correspondence with the plurality of luminous element groups 295. Light beams emitted from the luminous elements 2951 belonging to the luminous element groups 295 are guided to the microlens array 299 by the light guiding holes 2971 in one-to-one correspondence with the plurality of luminous element groups 295. The light beams having passed through the light guiding holes 2971 are focused as spots on the surface 211 of the photosensitive drum 21 by the microlens array 299 as shown by chain double-dashed line.

As shown in FIG. 21, an underside lid 2913 is pressed to the case 291 via the glass substrate 293 by a retainer 2914. Specifically, the retainer 2914 has an elastic force to press the underside lid 2913 toward the case 291, and seals the inside of the case 291 light-tight (that is, so that light does not leak from the inside of the case 291 and so that light does not intrude into the case 291 from the outside) by pressing the underside lid 2913 by means of the elastic force. It should be noted that a plurality of the retainers 2914 are provided at a plurality of positions in the longitudinal direction LGD of the case 291 shown in FIG. 20. The luminous element groups 295 are covered with a sealing member 294.

Figure 22:
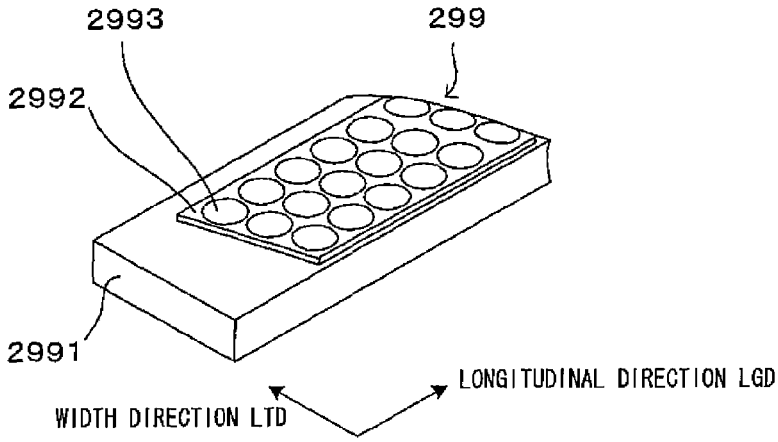
FIG. 22 is a schematic partial perspective view of the microlens array.
Figure 23:
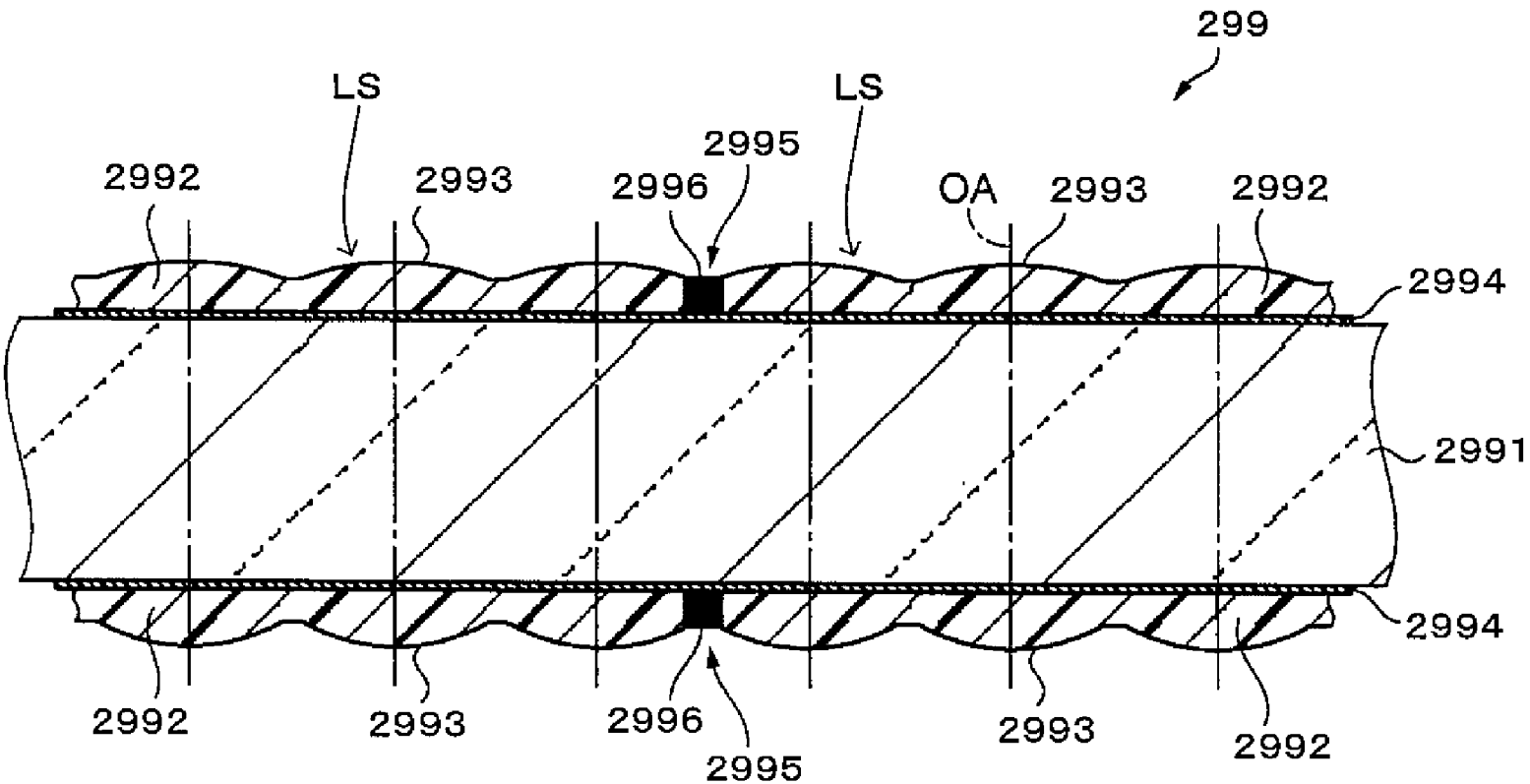
FIG. 23 is a partial section of the microlens array in the longitudinal direction.
Figure 24:
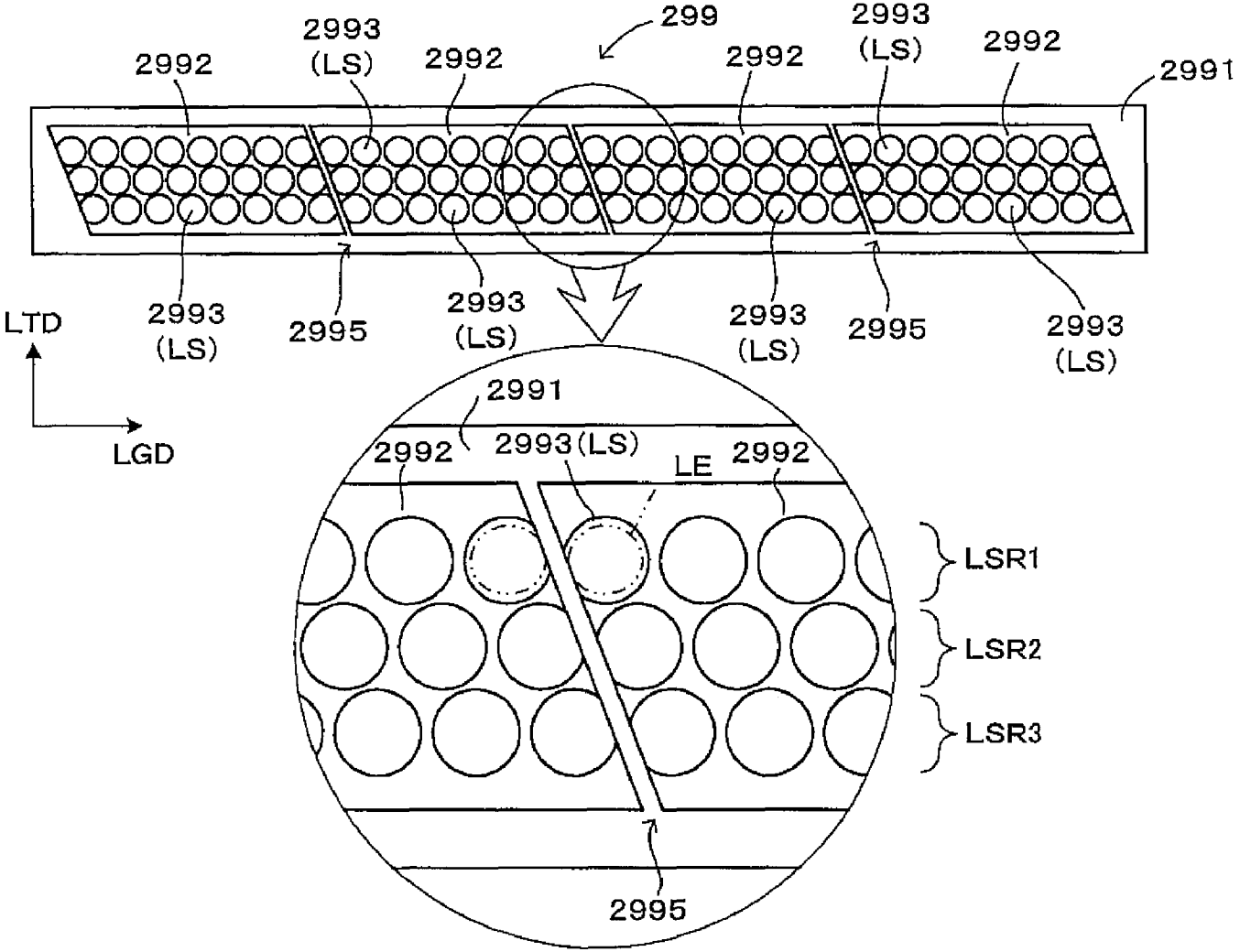
FIG. 24 is a plan view of the microlens array.

FIG. 22 is a schematic partial perspective view of the microlens array, FIG. 23 is a partial section of the microlens array in the longitudinal direction, and FIG. 24 is a plan view of the microlens array. In FIGS. 22 and 23, the microlens array 299 includes a glass substrate 2991 as a transparent substrate and a plurality of (eight in this embodiment) plastic lens substrates 2992. Since FIGS. 22 to 24 are partial views, they do not show all the parts.

In FIGS. 22 and 23, the plastic lens substrates 2992 are provided on the both surfaces of the glass substrate 2991. Specifically, as shown in FIG. 24, four plastic lens substrates 2992 are combined in a straight line and adhered to one surface of the glass substrate 2991 by an adhesive 2994. The shape of the microlens array 299 in plan view is rectangular. On the other hand, the shape of the plastic lens substrates 2992 is a parallelogram, and clearances 2995 are formed between the four plastic lens substrates 2992. Further, as shown in FIGS. 23 and 24, the clearances 2995 may be filled with a light absorbing material 2996, which can be selected from a wide variety of materials having a property of absorbing light beams emitted from the luminous elements 2951. For example, resin containing fine carbon particles and the like can be used. An enlarged view of the vicinity of the clearance 2995 is shown in a circle of FIG. 24.

The lenses 2993 are so arrayed as to form three lens rows LSR1 to LSR3 in the longitudinal direction LGD of the microlens array 299. The respective rows are arranged while being slightly displaced in the longitudinal direction LGD, and lens columns LSC are arrayed oblique to shorter sides of the rectangle in the case of viewing the microlens array 299 from above. The clearances 2995 are formed between the lens columns LSC along the lens columns LSC, and correspond to "combined positions" of the invention.

The respective clearances 2995 are so formed as not to enter lens effective ranges LE of the lenses 2993. The lens effective range LE is an area where the light beams emitted from the luminous element group 295 pass. As a method for forming the clearances 2995 in such a manner as not to enter lens effective ranges LE of the lenses 2993, there are a method for forming the end surfaces of the plastic lens substrates defining the clearances 2995 beforehand in such a manner as not to enter the lens effective ranges LE and a method for integrally forming a plurality of plastic lens substrates and, thereafter, cutting them in such a manner as not to enter the lens effective ranges LE.

Four plastic lens substrates 2992 are adhered to the other surface by the adhesive 2994 in correspondence with the above four lens substrates 2992. In this way, a biconvex lens is formed as an imaging lens by two lenses 2993 arranged in one-to-one correspondence on the both surfaces of the glass substrate 2991. It should be noted that the plastic lens substrates 2992 and the lenses 2993 can be integrally formed by resin injection molding using a die.

The two lenses 2993 forming the imaging lens have a common optical axis OA shown in dashed-dotted line. These plurality of lenses are arranged in one-to-one correspondence with the plurality of luminous element groups 295 shown in FIG. 20. In this specification, an optical system comprised of the two lenses 2993 and the glass substrate 2991 held between the lenses 2993 is called a "microlens LS". The microlenses LS as the imaging lenses are two-dimensionally (M×N) arranged in conformity with the arrangement of the luminous element groups 295 while being mutually spaced apart by specified distances in the longitudinal direction LGD (direction corresponding to the main scanning direction MD) and in the width direction LTD (direction corresponding to the sub scanning direction SD).

In the case of providing the clearances 2995 as above, that is, in the case of forming the lens array 299 by combining the plurality of lens substrates 2992, it is difficult to combine the lens substrates 2992 as designed and the lenses LS arranged at the opposite sides of the clearances 2995 might be relatively displaced in some cases. Accordingly, in this embodiment, the plurality of luminous element groups 295 are arranged in one-to-one correspondence with the microlenses LS arranged as above, but the device construction is differentiated in the vicinities where the lens substrates 2992 are combined (vicinities of the combined positions) and the other parts. The device construction and operation are described in each case below.

Figure 25:
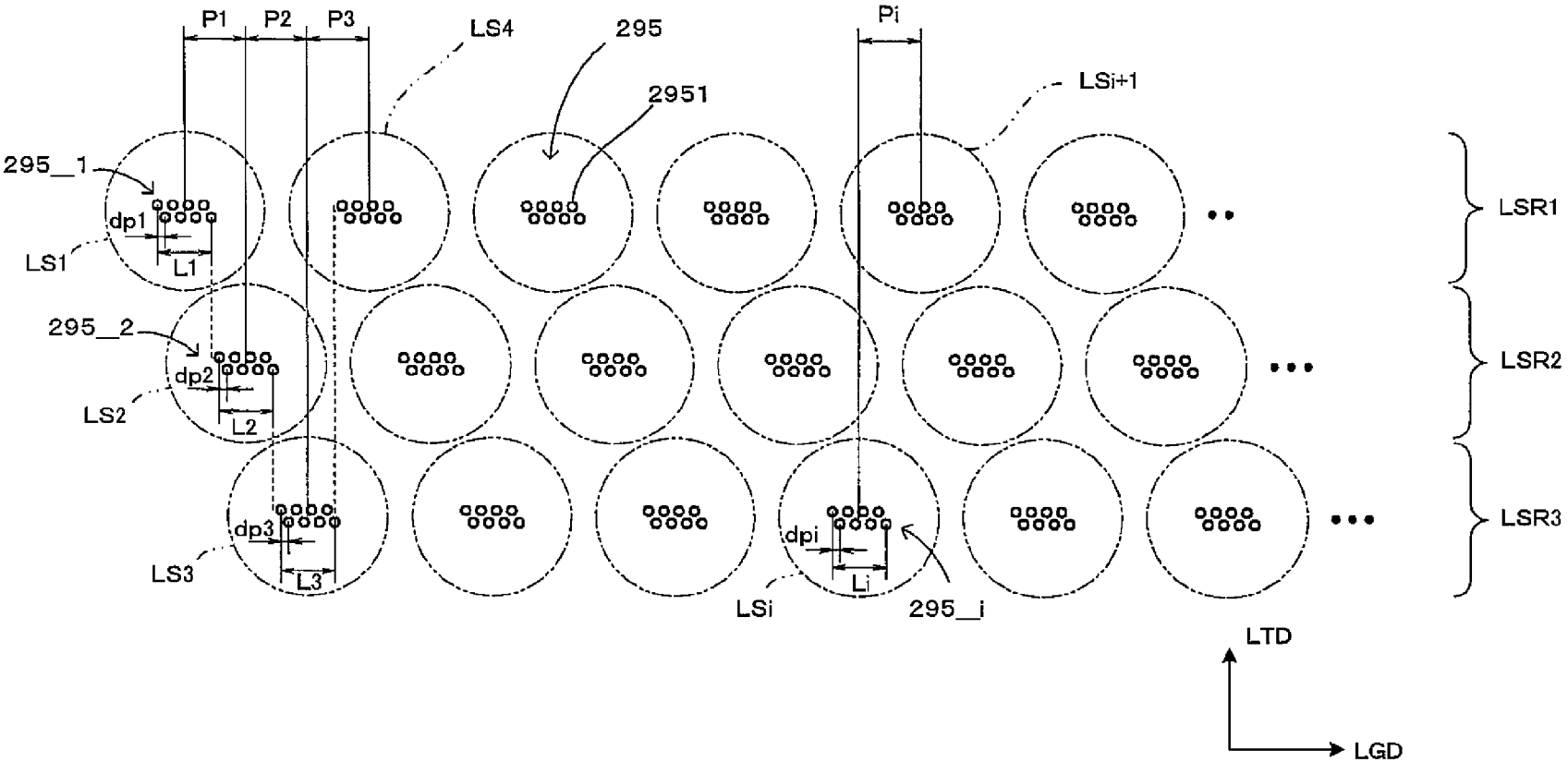
FIG. 25 is a diagram showing the arrangement relationship of the microlenses on the lens substrate and the luminous element groups corresponding to the microlenses.

FIG. 25 is a diagram showing the arrangement relationship of the microlenses on the lens substrate and the luminous element groups corresponding to the microlenses. In this line head, a specified number of luminous element groups 295 are arrayed while being mutually spaced apart in the longitudinal direction LGD to form the luminous element group row (295R in FIG. 2). A plurality of ("three" in this embodiment) luminous element group rows are arranged in the width direction LTD, whereby the plurality of luminous element groups 295 are arranged in a staggered manner. A spacing between the luminous element groups 295 adjacent to each other in the longitudinal direction LGD is equal to the distance between the optical axes of the microlenses LS. For example, as shown in FIG. 25, a distance P1 between the first lens LS1 and the second lens LS2, a distance P2 between the second lens LS2 and the third lens LS3, . . . in the longitudinal direction LGD are equal. Further, distances in the longitudinal direction LGD between the luminous element groups 295 corresponding to the lenses LS1 to LS3 are equal to the above distances.

Each of the luminous element groups 295 excluding those relating to special lens pairs to be described later includes eight luminous elements 2951, which are arranged as follows. Specifically, in each luminous element group 295, four luminous elements 2951 are aligned at specified pitches (=twice the element pitch dpi) in the longitudinal direction LGD to form a luminous element row (2951R in FIG. 1). Further, two luminous element rows are arranged in the width direction LTD. Furthermore, a shift amount of the luminous element rows in the longitudinal direction LGD is the element pitch dpi. Thus, in each luminous element group 295, all the luminous elements 2951 are arranged at mutually different longitudinal positions spaced apart by the element pitch dpi (=Pel). Accordingly, in each luminous element group 295, light beams emitted from the eight luminous elements 2951 are focused on the surface of the photosensitive drum 21 (hereinafter, "photosensitive surface") at mutually different positions in the main scanning direction MD by the microlens LS. In this way, eight spots are formed side by side in the main scanning direction MD to form a spot group SG. More specifically, the spot group SG is formed as follows.

Figure 26:
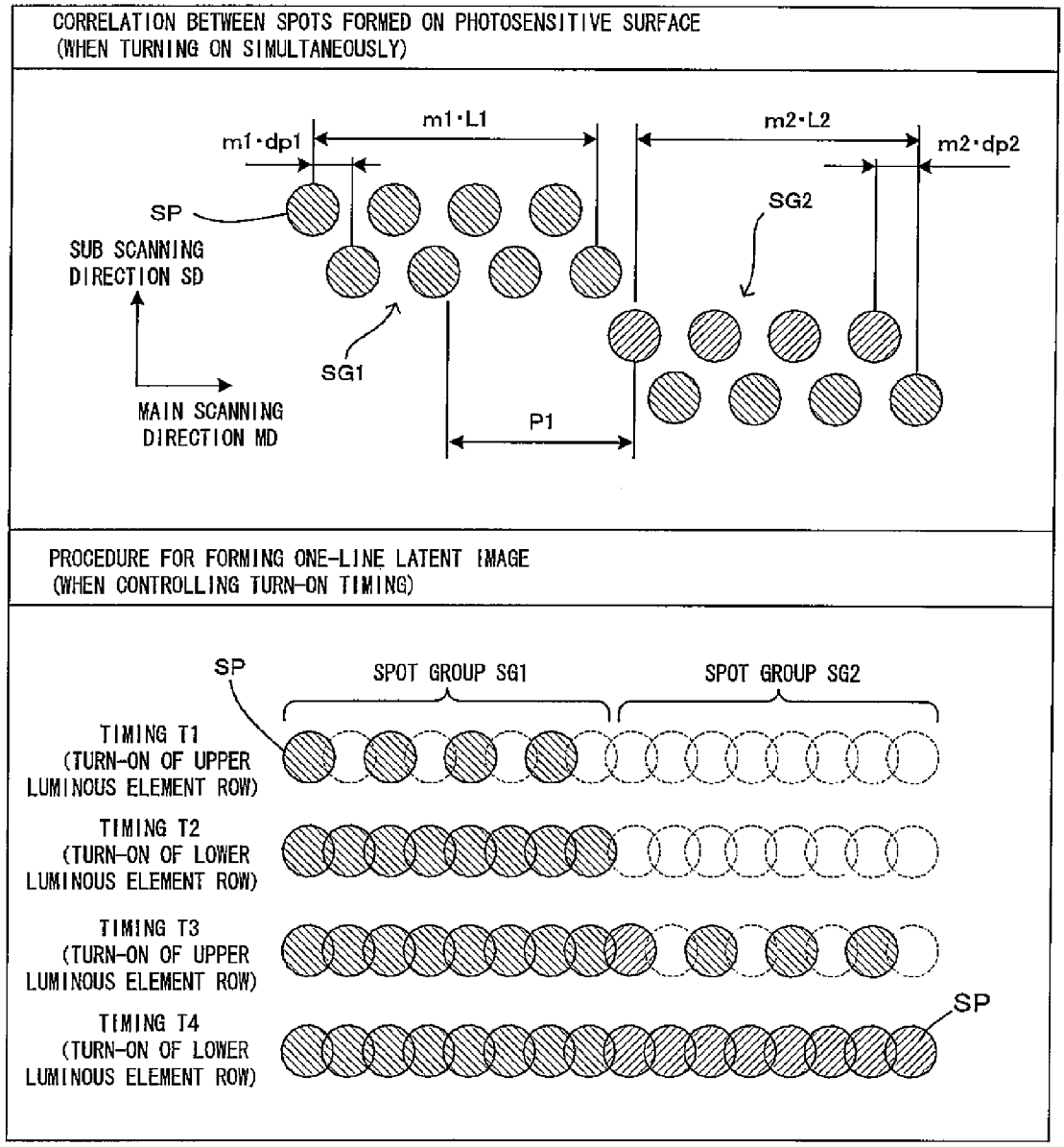
FIG. 26 is a diagram showing the positions of spots formed on the photosensitive surface by the line head.

FIG. 26 is a diagram showing the positions of spots formed on the photosensitive surface by the line head and diagrammatically shows a state where spots are formed by a luminous element group 295_1 corresponding to the first lens LS1 in FIG. 25 and a luminous element group 295_2 corresponding to the second lens LS2. It should be noted that a "spot group SG1" in FIG. 26 denotes a group of the spots SP formed by the luminous element group 295_1 at the upstream side (left side in FIG. 25) and a "spot group SG2" denotes a group of the spots SP formed by the luminous element group 295_2 at the downstream side (right side in FIG. 25). As shown in an upper part of FIG. 26, if the luminous elements 2951 are simultaneously turned on, the spot groups SG1 and SG2 formed on the photosensitive surface are also two-dimensionally arranged.

Accordingly, in this embodiment, the luminous elements 2951 constituting the luminous element row are turned on to emit light beams at timings in conformity with a rotational movement of the photosensitive drum 21 in each luminous element row as shown in a lower part of FIG. 26. In other words, the turn-on timings of the luminous element rows constituting the luminous element groups 295 are differentiated as follows in conformity with the rotational movement of the photosensitive drum 21.

(a) Timing T1: Turn the upper luminous element row of the luminous element group 295_1 on (b) Timing T2: Turn the lower luminous element row of the luminous element group 295_1 on (c) Timing T3: Turn the upper luminous element row of the luminous element group 295_2 on (d) Timing T4: Turn the lower luminous element row of the luminous element group 295_2 on Thus, the spots SP formed by the upper luminous element rows and those formed by the lower luminous element rows can be aligned in the main scanning direction MD only by this timing adjustment. In this way, the spots SP can be aligned in a line in the main scanning direction MD by a simple emission timing adjustment.

Figure 27:
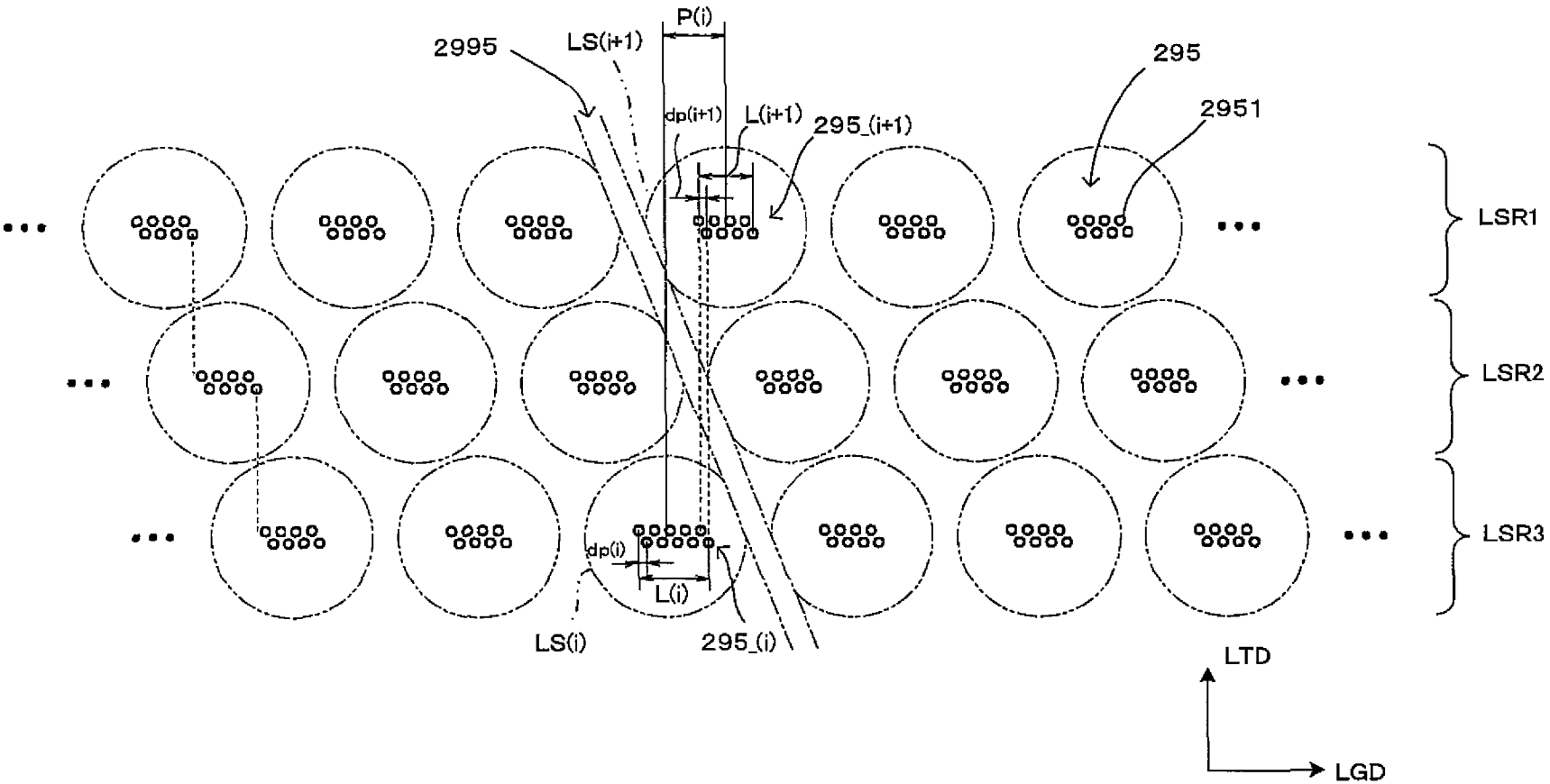
FIG. 27 is a diagram showing the arrangement relationship of the microlenses and the luminous element groups in the vicinity of the combined position.

FIG. 27 is a diagram showing the arrangement relationship of the microlenses and the luminous element groups in the vicinity of the combined position. In this vicinity of the combined position as well, the arrangement relationship and operation of the microlenses and the luminous element groups are basically the same as shown in FIG. 26. In other words, a plurality of lens pairs, a lens LS(i−1) and a lens LS(i) in FIG. 27 for instance, are formed on the same lens substrate 2992 in order to form the spot groups adjacent to each other in the main scanning direction MD, and the spot groups are formed similar to the lens pairs (lenses LS1 and LS2) by these lens pairs. However, the lens pairs paired at the opposite sides of the clearance 2995 and adapted to form the spot groups adjacent to each other in the main scanning direction MD (hereinafter, "special lens pairs"), the lens pairs each comprised of the lens LS(i) and a lens LS(i+1) in FIG. 27 for example, have a construction different from that of the lens pairs (hereinafter, "normal lens pairs") shown in FIG. 25. In other words, as shown in FIG. 27, in the luminous element group 295 corresponding to the lens LS(i), two additional luminous elements 2951 are provided. Specifically, in the luminous element group 295_(i), five luminous elements 2951 are aligned at specified pitches (=twice the element pitch dpi) in the longitudinal direction LGD to form the luminous element row (2951R in FIG. 2). Further, two luminous element rows are arranged in the width direction LTD. Furthermore, a shift amount of the luminous element rows in the longitudinal direction LGD is the element pitch dpi.

Figure 28:
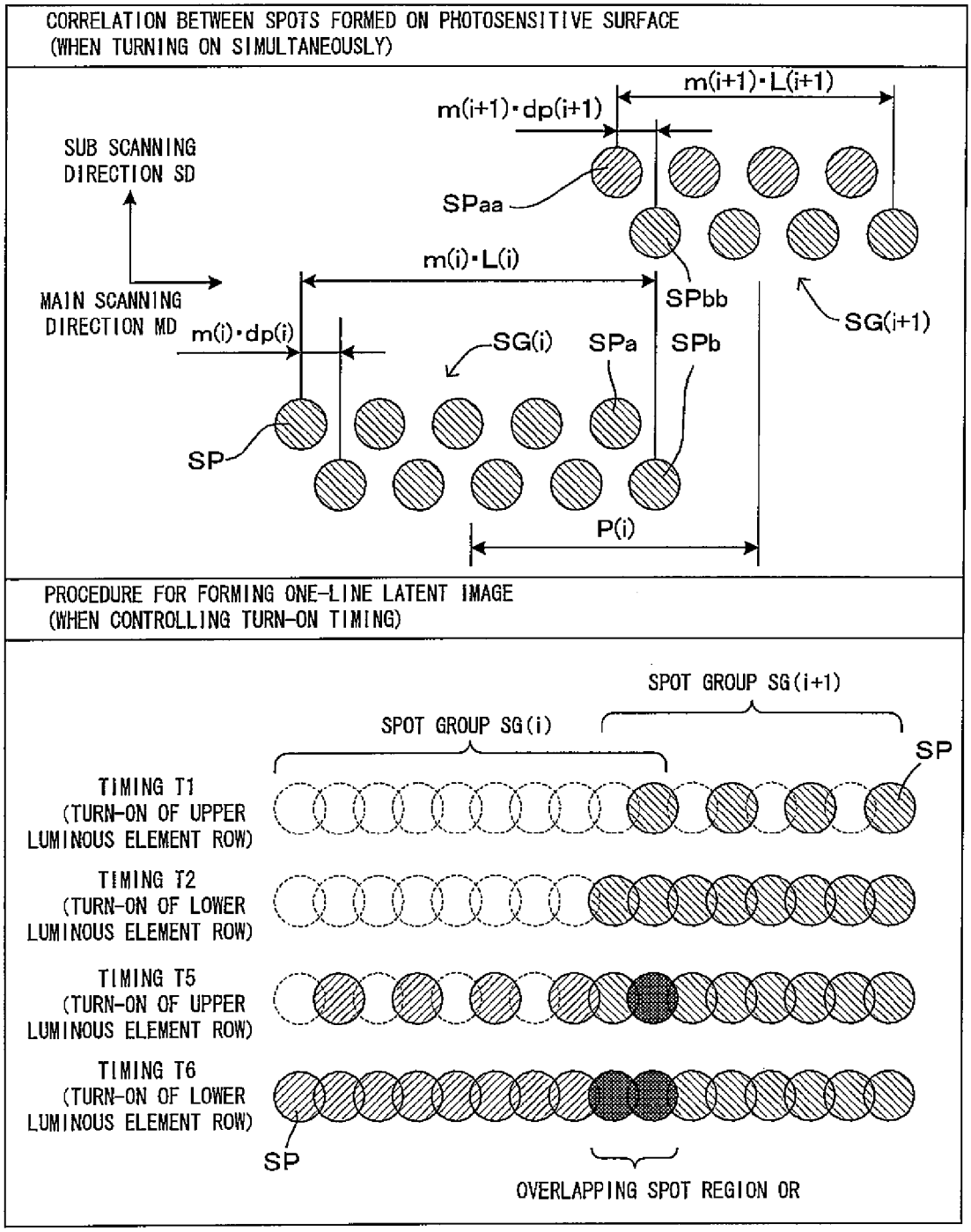
FIG. 28 is a diagram showing positions of spots formed on the photosensitive surface by the special lens pair and the luminous element groups corresponding to the special lens pair.

FIG. 28 is a diagram showing positions of spots formed on the photosensitive surface by the special lens pair and the luminous element groups corresponding to the special lens pair. In this embodiment, an inter-lens distance P(i) between the lenses LS(i) and LS(i+1) constituting the special lens pair satisfies the following expression:

$$m(i)L(i)+m(i+1)\cdot L(i+1)<2P(i)-\{m(i)\cdot dp(i)+m(i+1)\cdot dp(i+1)\} \quad (1)$$

where m(i) represents an optical magnification of the lens LS(i), L(i) represents a width in the longitudinal direction LGD of the luminous element group which corresponds to the lens LS(i), dp(i) represents a pitch of luminous elements 2951 in the longitudinal direction LGD in the luminous element group corresponding to the lens LS(i), m(i+1) represents an optical magnification of the lens LS(i+1), L(i+1) represents a width in the longitudinal direction LGD of the luminous element group which corresponds to the lens LS(i+1), and dp(i+1) represents a pitch of luminous elements 2951 in the longitudinal direction LGD in the luminous element group corresponding to the lens LS(i+1). It is to be noted that predesigned values, means of measured values, and the like may be used as the pitches dp(i) and dp(i+1).

Upon forming the spots by the special lens pair constructed in this way, spot groups SG(i) and SG(i+1) formed adjacent to each other in the main scanning direction MD partly overlap each other to form an overlapping spot region OR. Specifically, in this overlapping spot region OR, some (spots SPa and SPb in FIG. 28) of the spots by the luminous element group 295 corresponding to the lens LS(i) and some (spots SPaa and SPbb in FIG. 28) of the spots by the luminous element group 295 corresponding to the lens LS(i+1) overlap. In this specification, the spots SPa, SPb, SPaa and SPbb forming the overlapping spot region OR are called "overlapping spots".

If exposure is made to the photosensitive surface using the line head 29 constructed as above, a two-dimensional latent image L1 as shown in FIGS. 29A and 29B is obtained. Specifically, the spot groups adjacent to each other form the overlapping spot region OR by partly overlapping (FIG. 29A). This brings about the following effects. Specifically, upon producing the lens array 299, the lenses LS(i) and LS(i+1) paired at the opposite sides of the combined position (clearance 2995) of the lens substrates 2992 are relatively displaced due to assembling errors of the lens substrates 2992 and the like in some cases. If the lenses of the special lens pair are relatively displaced, a clearance is formed between the spot groups. On the other hand, since the special lens pair is so constructed as to satisfy the above relational expression (1) in this embodiment, the spots can be formed without causing these problems (FIG. 29B). In an image forming apparatus using the line head 29 constructed as above as an exposing device, high-quality images can be formed.

As described above, according to the fifth embodiment, the inter-lens distance P(i) between the lenses LS(i) and LS(i+1) constituting the special lens pairs (lenses LS(i) and LS(i+1) in FIG. 27) out of the lens pairs forming the spot groups SG adjacent to each other in the main scanning direction MD (lenses LS(λ) and LS(k+1) where k=1, 2, 3, . . . ) satisfies the above relational expression (1). Thus, the spot groups SG(i) and SG(i+1) adjacent to each other in the main scanning direction MD are so formed on the photosensitive surface (image plane) by the special lens pairs as to partly overlap in the sub scanning direction SD, thereby forming the overlap spot regions OR. Accordingly, even if the lenses of the special lens pairs are relatively displaced, the formation of clearances between the spot groups SG(i) and SG(i+1) can be prevented. Therefore, in an image forming apparatus adopting such a lens array 299, high-quality toner images can be formed without forming vertical lines.

Further, since a value {m(k)dp(k)} and a value {m(k+1)dp(k+1)} are equal in all the spot groups SG(k), where k=1, 2, 3, . . . , in the above embodiment, spot pitches Psp of the respective spot groups SG are equal, wherefore good spot formation can be carried out. Further, high-quality images can be obtained by performing image forming operations using such a line head.

Although only the special lens pairs satisfy the relational expression (1) here, all the lens pairs, that is, lenses LS(k) and LS(k+1), where k=1, 2, 3, . . . , for forming the spot groups SG adjacent to each other in the main scanning direction MD may satisfy the relational expression (1). In this case, the overlapping spot regions OR are formed between the adjacent spot groups SG as in the first embodiment.

Figure 30:
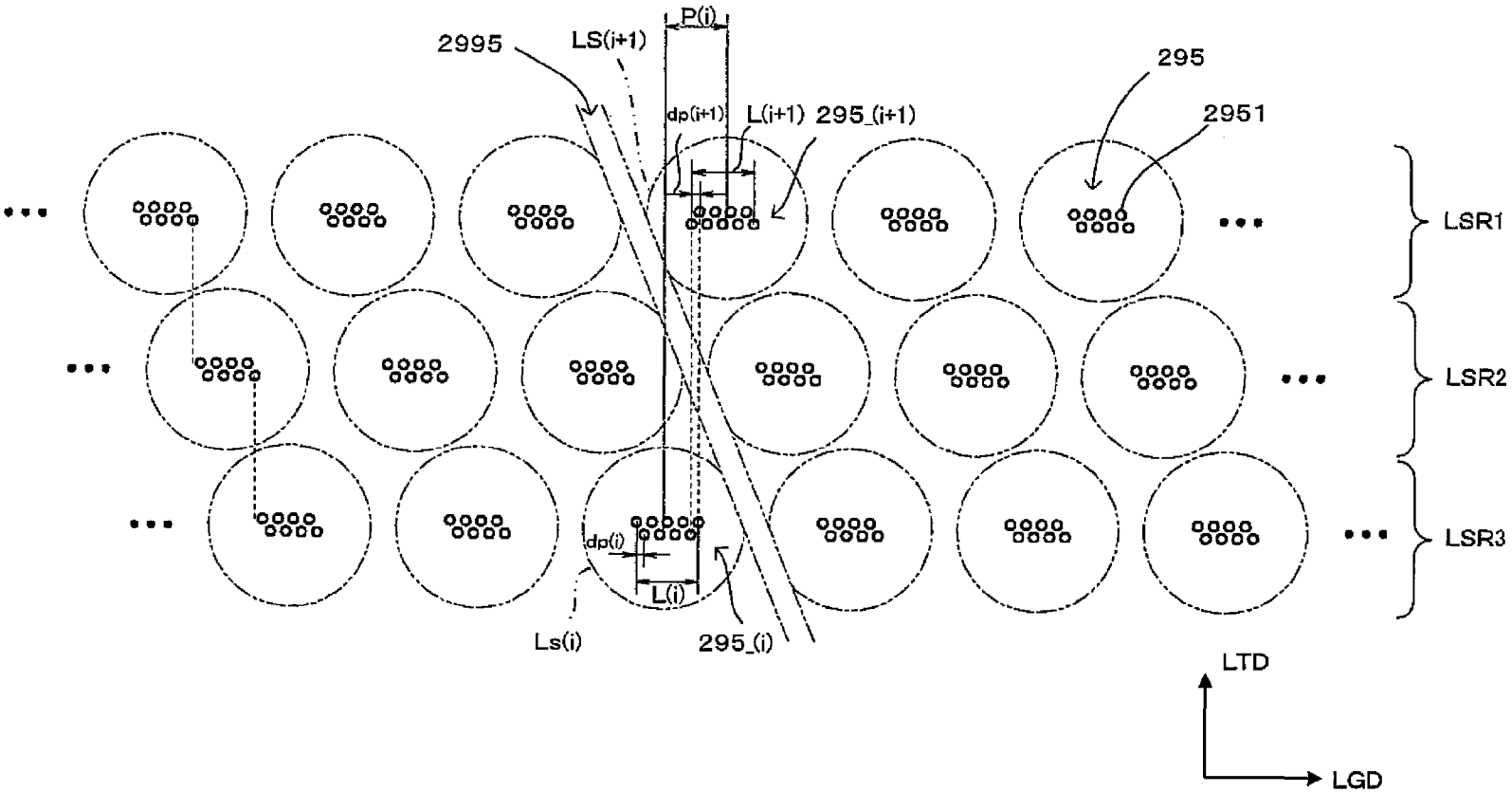
FIG. 30 is a diagram showing another embodiment of an image forming apparatus according to the invention.

Further, in the fifth embodiment, the number of the luminous elements 2951 constituting each luminous element group 295_(i) is increased by two to form the overlapping spot region OR. Here, the number of the luminous elements of the luminous element group 295_(i+1) corresponding to the other lens LS(i+1) constituting each special lens pair may be increased by two or the number of luminous elements may be increased by one in the luminous element groups 295_(i), 295_(i+1) as shown in FIG. 30. Further, the number of the overlapping luminous elements 2951 is not limited to "two" and is arbitrary.

Although the four lens substrates 2992 are combined in a straight line to form the lens array 299 in the above fifth embodiment, the invention is applicable to line heads in general in which a lens array is formed by combining a plurality of lens substrates in an arbitrary manner. Specifically, in the line head in which a plurality of lens substrates are combined, out of the lens pairs paired at the opposite sides of the combined positions of the lens substrates, the lens pairs for forming the spot groups adjacent to each other in the direction (main scanning direction MD) corresponding to the longitudinal direction (first direction) LGD satisfy the expression (1). Thus, the spot groups SG adjacent to each other in the main scanning direction MD are so formed on the photosensitive surface (image plane) by the special lens pairs as to partly overlap in the sub scanning direction SD, thereby forming the overlapping spot regions OR. Therefore, functions and effects similar to those of the above embodiment can be obtained in the line head and the image forming apparatus constructed as above.

G. Sixth Embodiment

Figure 31:
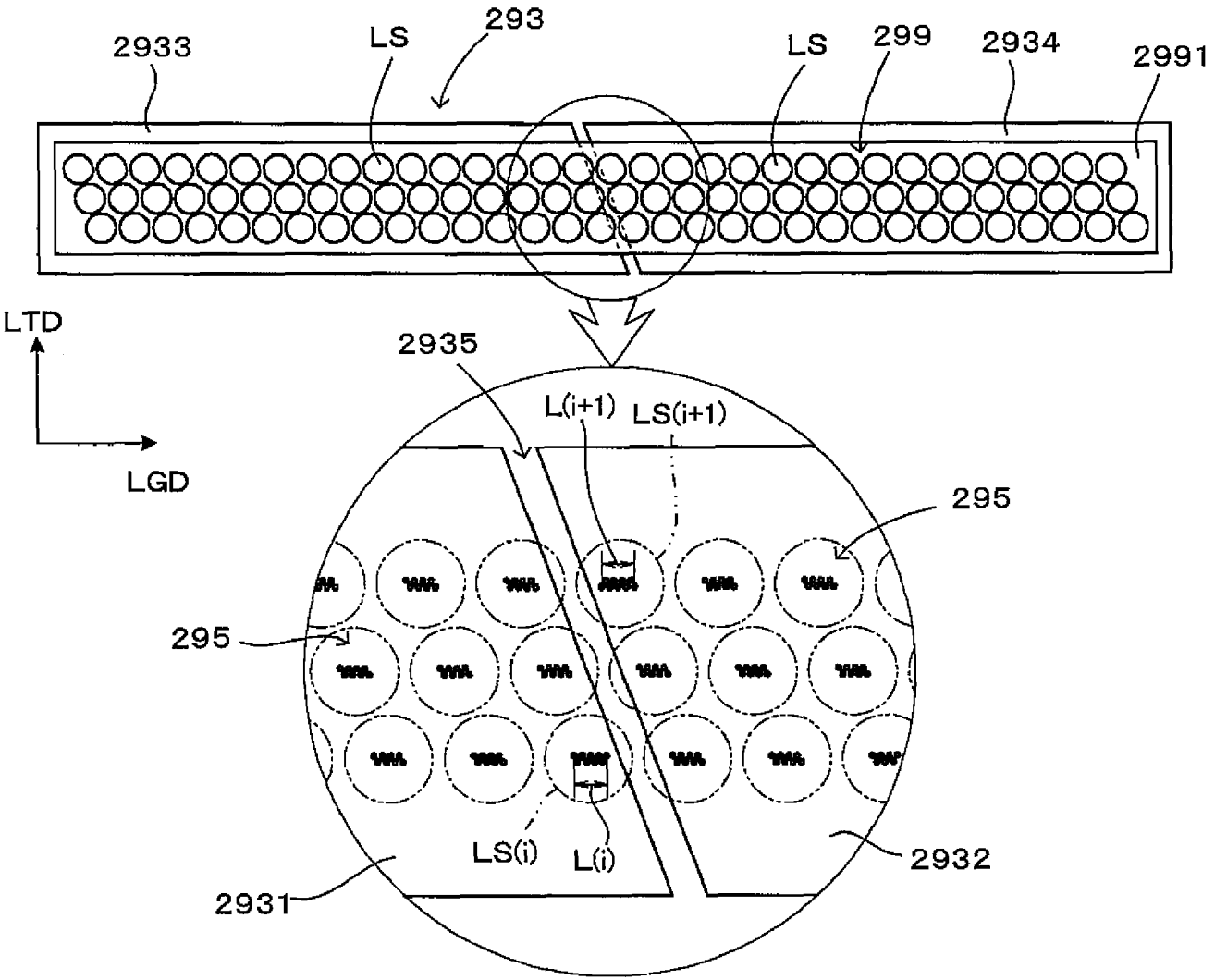
FIG. 31 is a diagram showing a sixth embodiment of an image forming apparatus according to the invention.

Although the lens array 299 is constructed by the dividing and assembling method in the above fifth embodiment, the head substrate 293 may be constructed by the dividing and assembling method. The invention is applicable to line heads and image forming apparatuses using this head substrate. For example, as shown in FIG. 31, the head substrate 293 may be constructed by combining element substrates 2933 and 2934 formed with luminous element groups 295. In this case, problems similar to those in the case of constructing the lens array by the dividing and assembling method might occur due to an assembling error at a combined position 2935 of the both element substrates 2933 and 2934. In other words, a vertical line might be formed between spot groups adjacent to each other in the main scanning direction MD. Accordingly, in the line heads and image forming apparatuses, functions and effects similar to those of the above embodiment can be obtained by the following construction. Specifically, out of lens pairs paired at the opposite sides of the combined position 2935 of the both element substrates 2933 and 2934 and facing the luminous element group pairs, a special lens pair, that is, lenses LS(i) and LS(i+1), for forming spot groups adjacent to each other in the main scanning direction MD corresponding to the longitudinal direction (first direction) LGD satisfies the relational expression (1). Thus, spot groups SG(i) and SG(i+1) adjacent to each other in the main scanning direction MD are so formed on the photosensitive surface (image plane) by the special lens pair as to partly overlap in the sub scanning direction SD, thereby forming the overlapping spot region OR. Therefore, even if the luminous element groups are displaced at the combined position 2935, good spot formation can be carried out and the formation of vertical lines can be reliably prevented.

H. Seventh Embodiment

Figure 32:
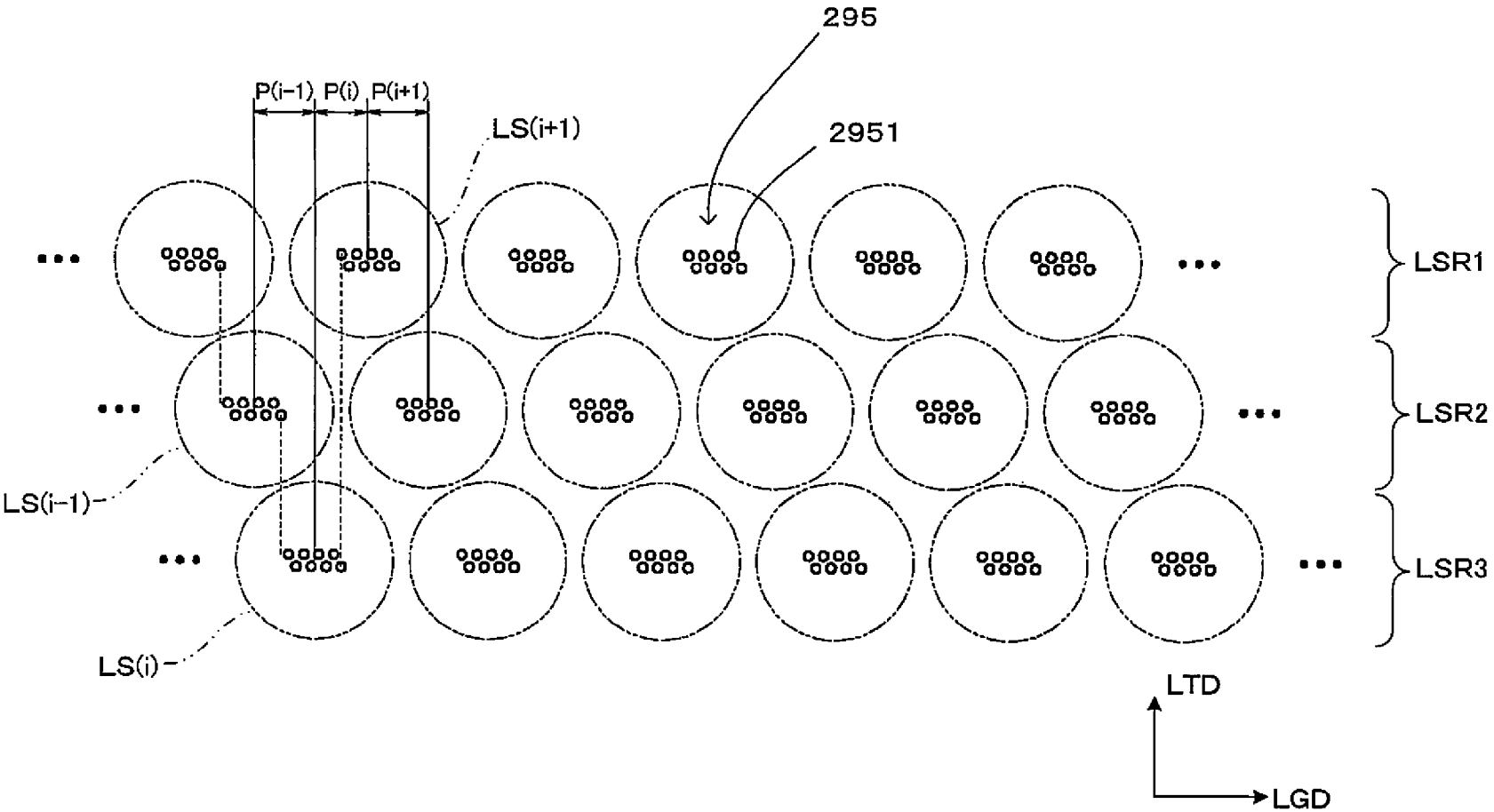
FIG. 32 is a diagram showing a seventh embodiment of an image forming apparatus according to the invention.

The invention is also applicable to line heads and image forming apparatuses using a lens array 299 and a head substrate 293 produced without adopting the dividing and assembling method. For example, in a device shown in FIG. 32, lenses LS are arrayed such that three lens rows LSR1 to LSR3 are formed in the longitudinal direction LGD of the microlens array 299. In the lens array 299 having such an array, problems occur in some cases similar to the above embodiments. In other words, with respect to the width direction (second direction) LTD, the lenses constituting the first lens row LSR1 and those constituting the third lens row are distanced in the width direction LTD. Accordingly, these lenses might be relatively displaced due to production errors and the like. If a relative displacement occurs in the lens pair for forming spot groups adjacent to each other in the main scanning direction MD corresponding to the longitudinal direction LGD, the lens pair comprised of lenses LS(i) and LS(i+1) in FIG. 32 for example, out of lens pairs constituted by these lenses, a clearance is formed between the spot groups. Thus, line heads and image forming apparatuses adopting such a lens array are preferably constructed such that an inter-lens distance P(i) between the lenses LS(i) and LS(i+1) satisfies the above expression (1), whereby spot groups SG(i) and SG(i+1) adjacent to each other in the main scanning direction MD are so formed on the photosensitive surface (image plane) by the special lens pair as to partly overlap in the sub scanning direction SD, thereby forming an overlapping spot region OR. Therefore, high-quality toner images can be formed without forming vertical lines.

Although the invention is applied to the device having three lens rows, that is, having N=3 in this embodiment, the invention is also applicable to devices having four or more lens rows. In other words, functions and effects similar to those of the above embodiment can be obtained by forming spot groups adjacent to each other in the main scanning direction MD on the photosensitive surface (image plane) in such a manner as to overlap in the sub scanning direction SD by a lens pair comprised of a lens constituting the first lens row with respect to the width direction LTD and a lens constituting the N-th lens row with respect to the width direction LTD.

I. Eighth Embodiment

Although the spots SP constituting the spot groups SG adjacent in the main scanning direction MD overlap in the overlapping spot region OR in the above embodiments, functions and effects similar to those of the above embodiments can be obtained even if the spots SP are formed while being displaced in the sub scanning direction SD. For example, if a gradation pattern subjected to a screen processing is formed by conventional technology (comparative example), a latent image L1 shown in FIGS. 33A and 33B is formed on the photosensitive surface (image plane). In other words, if no displacement or the like occurs, spot groups SG(i) and SG(i+1) adjacent to each other in the main scanning direction MD are continuously formed as shown in FIG. 33A. However, upon the occurrence of a displacement, the spot groups SG(i) and SG(i+1) are separated from each other to form a vertical line as shown in FIG. 33B.

On the other hand, in the eighth embodiment of the invention, spot groups are so formed on the photosensitive surface as to partly overlap in the sub scanning direction SD for some or all of combinations of spot groups adjacent in the main scanning direction MD. Thus, as shown in FIGS. 34A and 34B, an overlapping region WR is formed between the spot groups SG(i) and SG(i+1). Accordingly, not only in the case where neither displacements nor magnification errors occur (FIG. 34A), but also in the case where the mutual positional relationship of the luminous element groups 295 and the microlenses LS are slightly deviated or the magnification errors of the microlenses LS occur (FIG. 34B), the formation of clearances between the spot groups SG can be prevented and the latent image L1 satisfactorily subjected to the screen processing can be formed. Further, by performing image formation using such a line head 29, good gradation images can be formed without forming vertical lines.

J. Miscellaneous

The invention is not limited to the above embodiments and various changes other than the aforementioned ones can be made without departing from the gist of the invention. For example, in the above embodiments, two luminous element rows 2951R formed by aligning four, five or eight luminous elements 2951 at specified pitches in the longitudinal direction LGD are arranged in the width direction LTD. However, the configuration and arrangement (in other words, arrangement mode of a plurality of luminous elements) of the luminous element rows 2951R are not limited to these. In short, it is sufficient to arrange a plurality of luminous elements 2951 at different positions in the longitudinal direction LGD.

Although the organic EL (electroluminescence) devices are used as the luminous elements 2951 in the above embodiments, the specific construction of the luminous elements 2951 is not limited to this and LEDs (light emitting diodes) may be, for example, used as the luminous elements 2951.

Although the surface of the photosensitive drum 21 serves as the "image plane" of the invention in the above embodiments, the application subject of the invention is not limited to this. For example, the invention is also applicable to an apparatus using a photosensitive belt as shown in FIG. 35.

Figure 35:
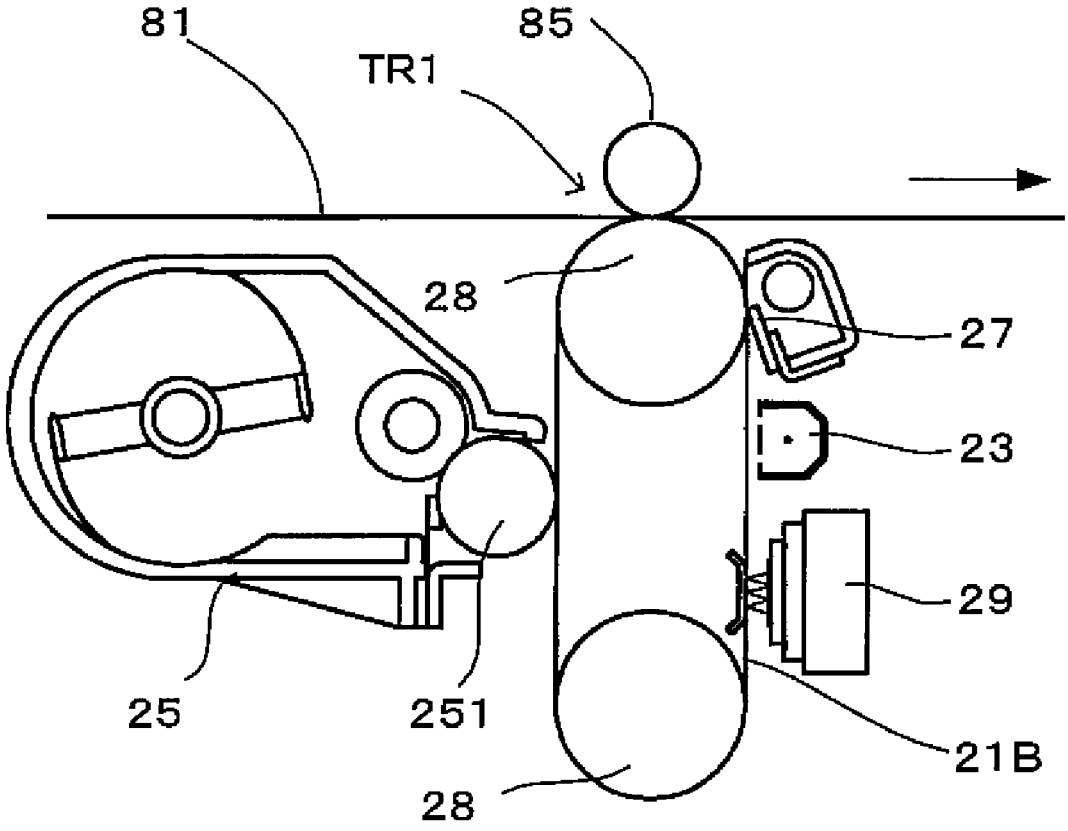
FIG. 35 is a diagram showing an image forming apparatus including a line head according to the invention.

FIG. 35 is a diagram showing an image forming apparatus including a line head according to the invention. This embodiment largely differs from the embodiment shown in FIG. 3 in the mode of the photosensitive member. Specifically, in this embodiment, a photosensitive belt 21B is used instead of the photosensitive drum 21. Since the other constructions are similar to the above embodiment, the identical constructions are identified by the same or corresponding reference numerals and are not described.

In this embodiment, the photosensitive belt 21B is mounted on two rollers 28 extending in the main scanning direction MD. This photosensitive belt 21B is driven and rotated in a specified direction of rotation D21 by an unillustrated drive motor. Further, a charger 23, a line head 29, a developing device 25 and a photosensitive belt cleaner 27 are arranged along the direction of rotation D21 around this photosensitive belt 21B. A charging operation, a latent image forming operation and a toner developing operation are performed by these functional devices.

In this embodiment, the line head 29 is arranged to face a position where the photosensitive belt 21B is flat. Accordingly, light beams for exposure from the line head 29 is vertically irradiated to the surface of the photosensitive belt 21B to form spots. Thus, the spots are irradiated to the flat surface of the photosensitive member, thereby being better formed. This is because, if the photosensitive drum 21 is a surface-to-be-scanned, the deformation of spots SP are unavoidable since the photosensitive surface is a curvature surface. On the other hand, in the apparatus using the photosensitive belt 21B, the photosensitive surface becomes flat, whereby the deformation of the spots SP can be prevented and better spot formation can be carried out.

Although the invention is applied to the color image forming apparatus in the above embodiment, the application thereof is not limited to this and the invention is also applicable to monochromatic image forming apparatuses which form monochromatic images.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A line head comprising:

a plurality of element substrates, each of which includes a luminous element group having a plurality of luminous elements, that are combined so that the luminous element groups are arrayed in M×N in a first direction and in a second direction that are different from each other, where M and N are integers equal to or greater than two, and a lens array that includes a plurality of lenses that face the luminous element groups, the lenses focusing light beams emitted from the luminous elements of the faced luminous element groups on an image plane and forming spot groups, wherein spot groups adjacent to each other in the direction corresponding to the first direction are so formed on the image plane as to overlap in the direction corresponding to the second direction by a luminous element group pair paired at the opposite sides of a combined position of the element substrates.

2. A line head comprising:

a plurality of luminous element groups that are arrayed in M×N in a first direction and in a second direction that are different from each other, where M is an integer equal to or greater than two and N is an integer greater than two, each luminous element group including a plurality of luminous elements; and a lens array that includes a plurality of lenses that face the luminous element groups, so as to form N lens rows each comprised of M lenses aligned in the first direction that are arranged in the second direction, the lenses focusing light beams emitted from the luminous elements of the faced luminous element groups on an image plane and forming spot groups, wherein spot groups adjacent to each other in the direction corresponding to the first direction are so formed on the image plane as to partly overlap in the direction corresponding to the second direction by a lens pair comprised of a lens constituting the first lens row with respect to the second direction and a lens constituting the N-th lens row with respect to the second direction.

* * * * *